US010794382B2

(12) United States Patent
Loerch et al.

(10) Patent No.: US 10,794,382 B2
(45) Date of Patent: Oct. 6, 2020

(54) SCREW COMPRESSOR WITH CONTROL SLIDER AND DETECTOR

(71) Applicant: BITZER Kuehlmaschinenbau GmbH, Sindelfingen (DE)

(72) Inventors: Roni Loerch, Neuenbuerg (DE); Klaus Feller, Herrenberg (DE); Tihomir Mikulic, Holzgerlingen (DE)

(73) Assignee: Bitzer Kuehlmaschinebau GmbH, Sindelfingen (DE)

( * ) Notice: Subject to any disclaimer, the term of this patent is extended or adjusted under 35 U.S.C. 154(b) by 448 days.

(21) Appl. No.: 15/482,021

(22) Filed: Apr. 7, 2017

(65) Prior Publication Data

US 2017/0211574 A1 Jul. 27, 2017

Related U.S. Application Data

(63) Continuation of application No. PCT/EP2015/072934, filed on Oct. 5, 2015.

(30) Foreign Application Priority Data

Oct. 8, 2014 (DE) ..... 10 2014 114 605
Sep. 28, 2015 (DE) ..... 10 2015 116 324

(51) Int. Cl.
*F03C 2/00* (2006.01)
*F03C 4/00* (2006.01)
(Continued)

(52) U.S. Cl.
CPC ..... *F04C 28/20* (2013.01); *F04C 18/16* (2013.01); *F04C 28/12* (2013.01); *F04C 28/28* (2013.01);
(Continued)

(58) Field of Classification Search
CPC ..... F04C 18/16; F04C 28/12; F04C 28/20; F04C 28/28; F04C 2240/30; F04C 2240/56; F04C 2240/81
(Continued)

(56) References Cited

U.S. PATENT DOCUMENTS 3,432,089 A * 3/1969 Schibbye ..... F04C 28/125 418/201.2
3,936,239 A * 2/1976 Shaw ..... F04C 28/125 418/201.2
(Continued)

FOREIGN PATENT DOCUMENTS

DE 3422573 A1 12/1985
EP 1498611 A1 1/2005
(Continued)

*Primary Examiner* — Theresa Trieu
(74) *Attorney, Agent, or Firm* — Reinhart Boerner Van Deuren P.C.

(57) ABSTRACT

A screw compressor includes a compressor housing which has a screw rotor chamber arranged therein. Two screw rotors are arranged in the screw rotor chamber. At least one control slider is arranged in a slider channel of the compressor housing and is adjacent to both screw rotors by means of slider compression wall surfaces. The control slider is moveable in a direction of displacement parallel to the screw rotor axes. There is a position determining device for the at least one control slider. The position determining device has a position indicator that is coupled to the at least one control slider. The position indicator cooperates with a detector that extends parallel to the direction of displacement of the at least one control slider and along which the position indicator is moveable. The detector element is coupled to an evaluation device that determines the positions of the position indicator along the detector.

48 Claims, 18 Drawing Sheets

(51) Int. Cl.

| | |
|---|---|
| ***F04C 18/00*** | (2006.01) |
| ***F04C 28/20*** | (2006.01) |
| ***F04C 18/16*** | (2006.01) |
| ***F04C 28/12*** | (2006.01) |
| ***F04C 28/28*** | (2006.01) |

(52) U.S. Cl.
CPC ..... *F04C 2240/30* (2013.01); *F04C 2240/56* (2013.01); *F04C 2240/81* (2013.01)

(58) Field of Classification Search
USPC ..... 418/2, 21, 201.1, 201.2
See application file for complete search history.

(56) References Cited

U.S. PATENT DOCUMENTS 4,249,866 A * 2/1981 Shaw ..... F04C 28/125 418/201.2
4,519,748 A 5/1985 Murphy et al.
4,610,612 A 9/1986 Kocher
4,678,406 A * 7/1987 Pillis ..... F04C 28/125 418/201.2
4,743,170 A * 5/1988 Marshall ..... F04C 28/24 417/310
4,909,716 A * 3/1990 Orosz ..... F04C 28/125 418/201.2
5,183,395 A * 2/1993 Langouet ..... F04C 28/125 418/201.2
5,257,921 A 11/1993 Clarke et al.
2005/0013702 A1 1/2005 Dieterich et al.
2010/0254845 A1* 10/2010 Nemit, Jr. ..... F04C 28/125 418/201.2
2013/0315766 A1* 11/2013 Kitano ..... F04C 18/16 418/21

FOREIGN PATENT DOCUMENTS

GB 2331574 A 5/1999
JP S58101289 A 6/1983
JP 01035092 A * 2/1989 ..... F04C 28/125
JP 04058092 A * 2/1992 ..... F04C 28/12
WO WO 93/18307 A1 9/1993

* cited by examiner 10
218
SPH
16
3
3
212
2
192
14
12
MV1
MV2
2

Position 100% output, minimum Vi

Position 100% output, maximum Vi

Position with partial load of 75%

Position with partial load of 50%

Position with partial load of 25%

SCREW COMPRESSOR WITH CONTROL SLIDER AND DETECTOR

CROSS-REFERENCE TO RELATED PATENT APPLICATION

This application is a continuation of International application number PCT/EP2015/072934 filed on Oct. 5, 2015.

This patent application claims the benefit of International application No. PCT/EP2015/072934 of Oct. 5, 2015 and German applications No. 10 2014 114 605.0 of Oct. 8, 2014 and No. 10 2015 116 324.1 of Sep. 28, 2015, the teachings and disclosure of which are hereby incorporated in their entirety by reference thereto.

BACKGROUND OF THE INVENTION

The invention relates to a screw compressor, including a compressor housing having a screw rotor chamber arranged therein, two screw rotors that are arranged in the screw rotor chamber and are mounted on the compressor housing, each rotatably about a respective screw rotor axis, and engage in each other by means of their helical contours and each cooperate with compression wall surfaces which are adjacent thereto and partly surround them in order to receive gaseous medium that is supplied by way of a low-pressure chamber arranged in the compressor housing and to discharge it in the region of a high-pressure chamber that is arranged in the compressor housing, wherein the gaseous medium is enclosed in compression chambers that are formed between the helical contours and compression wall surfaces that are adjacent to the latter with an intake volume at low pressure and is compressed to a final volume at high pressure, and including at least one control slider that is arranged in a slider channel of the compressor housing and is adjacent to both screw rotors by means of slider compression wall surfaces and is movable in a direction of displacement parallel to the screw rotor axes and takes a form that affects the final volume and/or the initial volume.

Screw compressors of this kind are known from the prior art.

These screw compressors have the problem of determining precisely the position of the control slider.

SUMMARY OF THE INVENTION

This object is achieved according to the invention in the case of a screw compressor of the type mentioned in the introduction in that a position determining device is provided for the at least one control slider, in that the position determining device has a position indicator element that is coupled to the at least one control slider, in that the at least one position indicator element cooperates with a detector element that extends parallel to the direction of displacement of the control slider and along which the position indicator element is movable when the at least one control slider is moved, and in that the detector element is coupled to an evaluation device that determines the respective position of the position indicator element along the detector element.

The advantage of the solution according to the invention can be seen in particular in the fact that it enables very precise determination of position with a simple construction.

In particular in the case of a screw compressor that has two control sliders, wherein a first control slider takes a form that affects at least the final volume and a second control slider takes a form that affects at least the initial volume, it is provided for a position determining device to be provided for the two control sliders that includes a first position indicator element, coupled to the first control slider, and a second position indicator element, coupled to the second control slider, for both position indicator elements to cooperate with a common detector element that extends parallel to the direction of displacement of the control sliders and along which the position indicator elements are movable when the control sliders are moved, and for the detector element to be coupled to an evaluation device that determines the respective positions of the first position indicator element and the second position indicator element along the detector element.

This solution has the major advantage of providing the possibility of determining, even when there are two control sliders, the positions thereof precisely and in particular at the same time, in particular using a single detector element.

More detailed statements have not yet been made as regards the arrangement of the detector element.

Here, an advantageous solution provides for the detector element to be arranged in a detector channel that extends within the compressor housing, parallel to the direction of displacement, with the result that the detector element is protected to the optimum by external influences by the detector channel within the compressor housing.

It is particularly advantageous if the detector channel is closed by a cover, with the result that simple access to the detector channel is possible by way of the cover.

More detailed statements have not yet been made as regards the form taken by the detector channel.

Here, an advantageous solution provides for the detector channel to be formed by a groove-like recess, which spans the cover, in a base body of the housing.

Another advantageous solution provides for the cover itself to have a groove-like recess that forms part of the detector channel.

So that the detector element can be assembled with the cover simply, an advantageous solution provides for the detector element to extend within the recess in the cover, with the result that the detector element is removable together with the cover and where appropriate replaceable.

Further, it is provided for the at least one position indicator element to be arranged in the detector channel and to be movable therein in the direction of displacement.

More detailed statements have not yet been made as regards the coupling of the at least one position indicator element to the at least one control slider.

Here, in theory the coupling between the position indicator element and the control slider could be made without contact.

However, for the reliable indicator of the position of the at least one control slider, it is advantageous if the at least one position indicator element is mechanically coupled to the respective control slider by way of a connecting body and thus the position indicator element is carried rigidly along with the respective control slider.

In order to make the connection between the respective position indicator element that is movable in the detector channel and the control slider, it is preferably provided for the respective connecting body to pass through an elongate passage between the detector channel and a slider channel that receives the at least one control slider.

It is particularly favourable if the respective connecting body and the passage together guide the respective control slider in the direction of displacement such that it cannot rotate, with the result that guidance of the control sliders such that they cannot rotate is achievable at the same time without the need for separate guidance by a groove in the control slider and a groove block in the compressor housing.

A more detailed specification has not yet been given on the cooperation between the at least one position indicator element and the detector element.

Here, a particularly advantageous solution provides for the respective position indicator element to cooperate with the detector element without contact, with the result that the position of the position indicator elements may be determined without wear.

Preferably, here, the detector element is made from a magnetostrictive material, and the position indicator element generates, at its location, a local magnetic flux of the detector element that can then be sensed in the detector element by way of the evaluation device.

A particularly favourable solution provides a controller that controls a slider drive for the respective control slider and determines a movement of the respective control slider by means of the position determining unit.

Thus, the controller is able not only to move the respective control slider with the slider drive but also precisely to follow the performed movement.

This is particularly advantageous if the slider drive takes the form of a cylinder arrangement configured to be urged by a medium.

The controller can be used particularly advantageously if the controller positions the respective control slider in a position-controlled manner.

This means that the controller on the one hand controls the slider drive and on the other hand can determine, by determining the position of the respective control slider, whether the desired position has been reached or not, and can then also move to this position by a corresponding control of the slider drive, and for example maintain this position over the long term.

It is thus possible, by means of a compressor control program of the controller, or a higher-level controller, to predetermine individual positions of the respective control slider or where appropriate plurality of control sliders, and then to move to and maintain this position in a position-controlled manner using the controller such that any intermediate positions between the extreme positions are possible in order to operate the screw compressor to the optimum.

Here, it is particularly advantageous if, when determining the positions of the control sliders, the controller takes into account at least one or more of the parameters such as the pressure level at low pressure, the pressure level at high pressure, the temperature of the gaseous medium at high pressure and low pressure, the speed of rotation of the screw rotors, the power consumption of a drive motor, the parameters of the gaseous medium, in particular of the refrigerant, and the application limits of the screw compressor.

More detailed statements have not yet been made as regards the arrangement of two control sliders in relation to one another.

Here, it is advantageously provided for the first control slider and the second control slider to be arranged one behind the other in the direction of displacement thereof.

If the two control sliders are arranged one behind the other, it is provided in particular for the first control slider and the second control slider to have identical external contours.

Preferably, two control sliders lying one behind the other are usable such that the first control slider and the second control slider are positionable directly succeeding one another in a combined position and are movable together in the direction of displacement.

As an alternative thereto, in the case of two control sliders lying one behind the other, it is possible for the first and the second control slider to be positionable in a separated position, spaced from one another, forming an intermediate space.

As an alternative to providing two control sliders lying one behind the other, a further advantageous solution provides for the first control slider to have mutually directly adjacent slider compression wall surfaces, of which in each case one faces one of the screw rotors, and for the second control slider to have compression wall surface regions that are arranged spaced from one another, of which in each case one is adjacent to one of the screw rotors, and between which the slider compression wall surfaces of the first control slider lie.

With such an arrangement of two control sliders, it is possible preferably to affect the final volume by means of the first control slider and to affect the initial volume by means of the second control slider, by way of the slider compression wall surfaces that are arranged spaced from one another.

Preferably here, it is provided for the first control slider to be mounted on the second control slider.

Preferably here, the first control slider is mounted in a slider channel of the second control slider.

Moreover, it is preferably provided for the slider compression wall surfaces of the first control slider and the slider compression wall surfaces of the second control slider to succeed one another.

The solution according to the invention has the further object of reducing the development of noise in a screw compressor of the type described in the introduction.

This object is achieved according to the invention in the case of a screw compressor of the type described in the introduction or a screw compressor according to one of the above features in that the first control slider and the second control slider are arranged one behind the other in the direction of displacement thereof, in that the first control slider is arranged on a side of the second control slider facing the high-pressure chamber, and in that the first control slider is guided in relation to the second control slider by a telescopic guide.

As a result of a telescopic guide of the first control slider, in addition to guidance of the first control slider in the slider channel provided therefor, the movability of the second control slider during operation of the screw compressor according to the invention, in particular during the occurrence of pressure pulses, is reduced, and hence noise generated by the first control slider as a result of pressure pulses is also reduced.

It is particularly advantageous here if the telescopic guide has a smaller play transversely to the direction of displacement than guidance of the first control slider through a slider channel receiving the latter.

As a result, the movability of the first control slider can be further restricted, and hence also the noise caused thereby in the event of pressure pulses.

In particular, it is advantageous here if the telescopic guide has a guide body that is rigidly connected to the second control slider and on which the first control slider is movably guided in the direction of displacement by means of a guide bushing.

A construction of the telescopic guide of this kind provides the possibility, in a particularly simple manner, of reducing the movability of the first control slider in relation to the slider channel.

A further advantageous solution provides for the first control slider to be guided on the guide body exclusively by means of the guide bushing.

A solution of this kind allows guidance of the first control slider in relation to the second control slider to be made even more precise without hindering the movability of the first control slider in the direction of displacement.

It is particularly advantageous if the guide bushing is arranged at an end of the first control slider facing the second control slider.

The most diverse possibilities are conceivable for the arrangement of the guide bushing.

For example, it would be conceivable to arrange the guide bushing at the end of the first control slider.

However, a particularly advantageous solution provides for the guide bushing to be arranged in the inner guide receptacle for the guide body, which is provided in the first control slider.

In order to reduce to a further extent the noise generated in a screw compressor according to the invention, it is further preferably provided for the first control slider to be rigidly connected to a piston rod that leads to a cylinder arrangement for moving the first control slider, and for the first control slider to be guided in relation to the compressor housing by means of a guide bushing that receives the piston rod such that it is movable in the direction of displacement.

A solution of this kind provides a further additional guidance of the first control slider in relation to the compressor housing, which additionally reduces the movement of the first control slider in relation to the compressor housing and in particular in relation to the slider channel.

In particular, it is provided here for the piston rod to be arranged on an opposite side of the first control slider to the second control slider.

Preferably, in this case the piston rod extends parallel to the direction of displacement.

It is particularly advantageous as regards the arrangement of the guide bushing if the latter is held fixedly on the compressor housing.

Further, it is preferably provided for a play between the guide bushing and the piston rod transversely to the direction of displacement to be smaller than the play of the control slider guided in the slider channel transversely to the direction of displacement.

In particular, when there are two control sliders arranged one behind the other, it is provided for the first control slider and the second control slider to have identical external contours.

A solution of this kind makes it possible, in a particularly simple manner, to guide the two control sliders in a common slider channel.

Further, the two control sliders that lie one behind the other are advantageously to be used such that the first control slider and the second control slider are positionable directly succeeding one another in a combined position and are movable together in the direction of displacement.

Further, when there are two control sliders lying one behind the other, it is provided for the first and the second control slider to be positionable in a separated position, spaced from one another, forming an intermediate space.

Further features and advantages of the invention form the subject matter of the description below and the representation in the drawing of some exemplary embodiments.

DETAILED DESCRIPTION OF THE INVENTION

Figure 1:
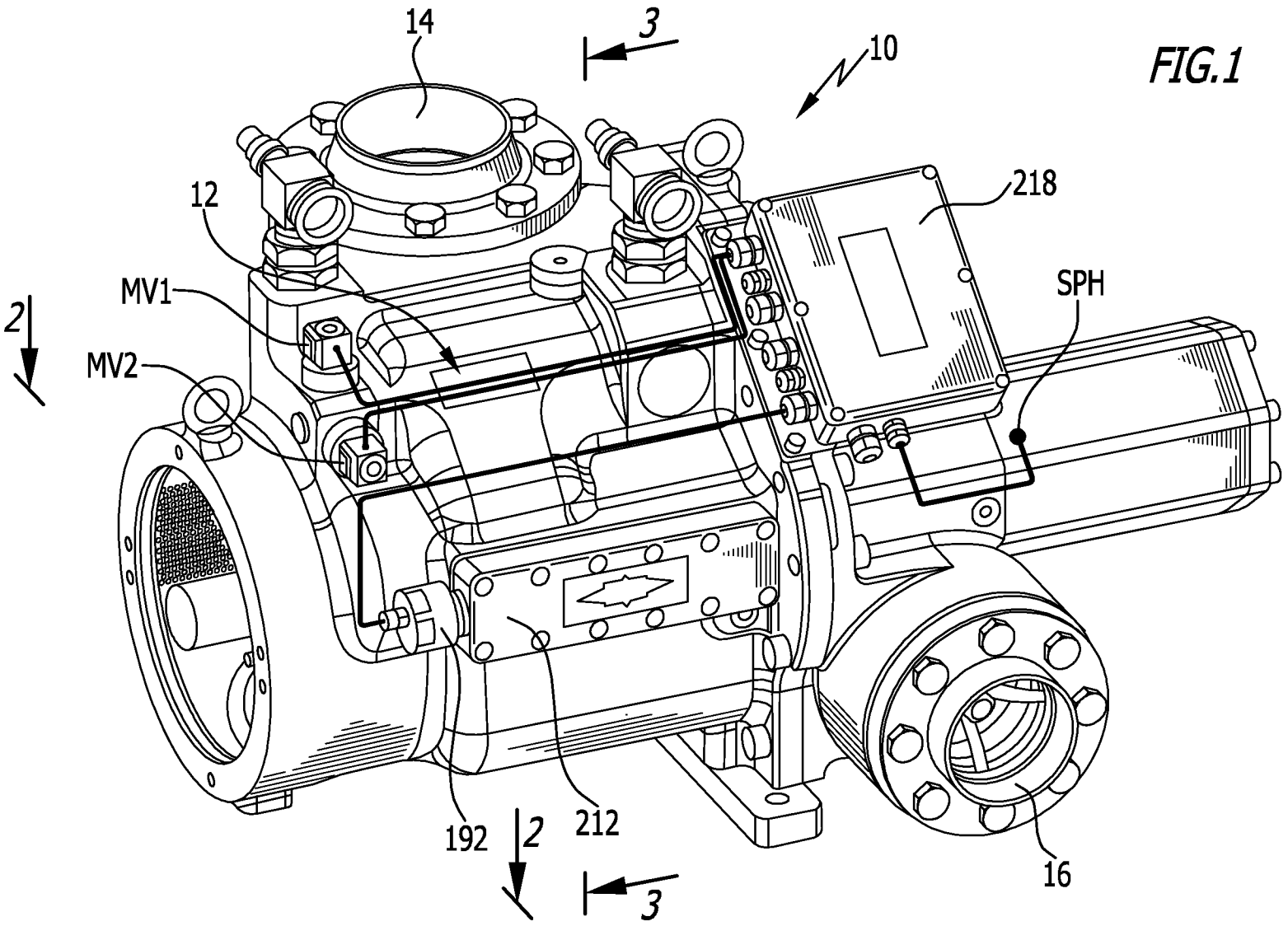
FIG. 1 shows a perspective view of a first exemplary embodiment of a screw compressor according to the invention.

An exemplary embodiment, illustrated in FIG. 1, of a screw compressor 10 according to the invention includes a compressor housing that is designated 12 as a whole and that has an intake connector 14 through which a gaseous medium to be drawn in, in particular refrigerant, is drawn in and that has a pressure connector 16 through which the gaseous medium that has been compressed to high pressure, in particular refrigerant, is discharged.

Figure 2:
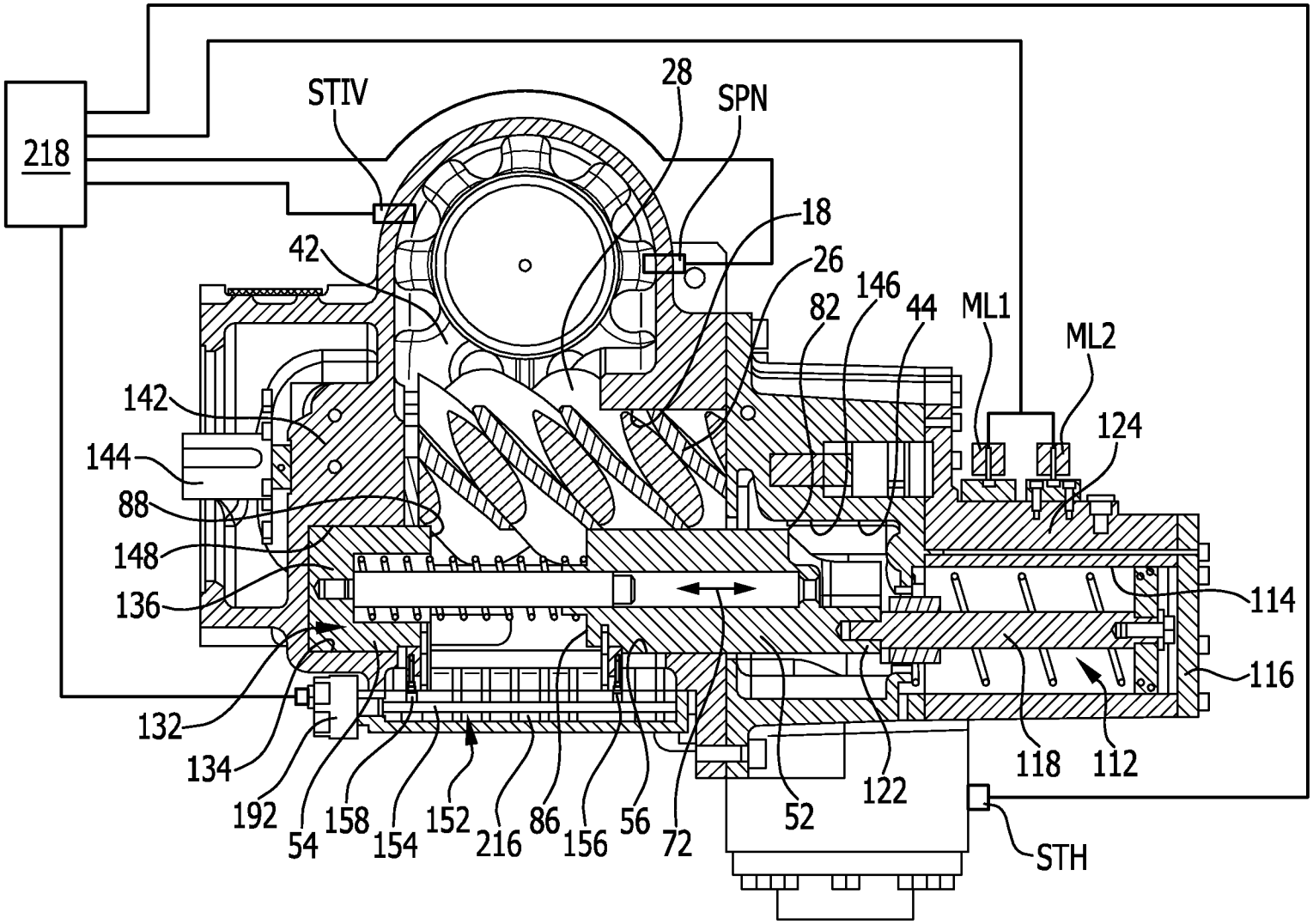
FIG. 2 shows a section along the line 2-2 in FIG. 1.
Figure 3:
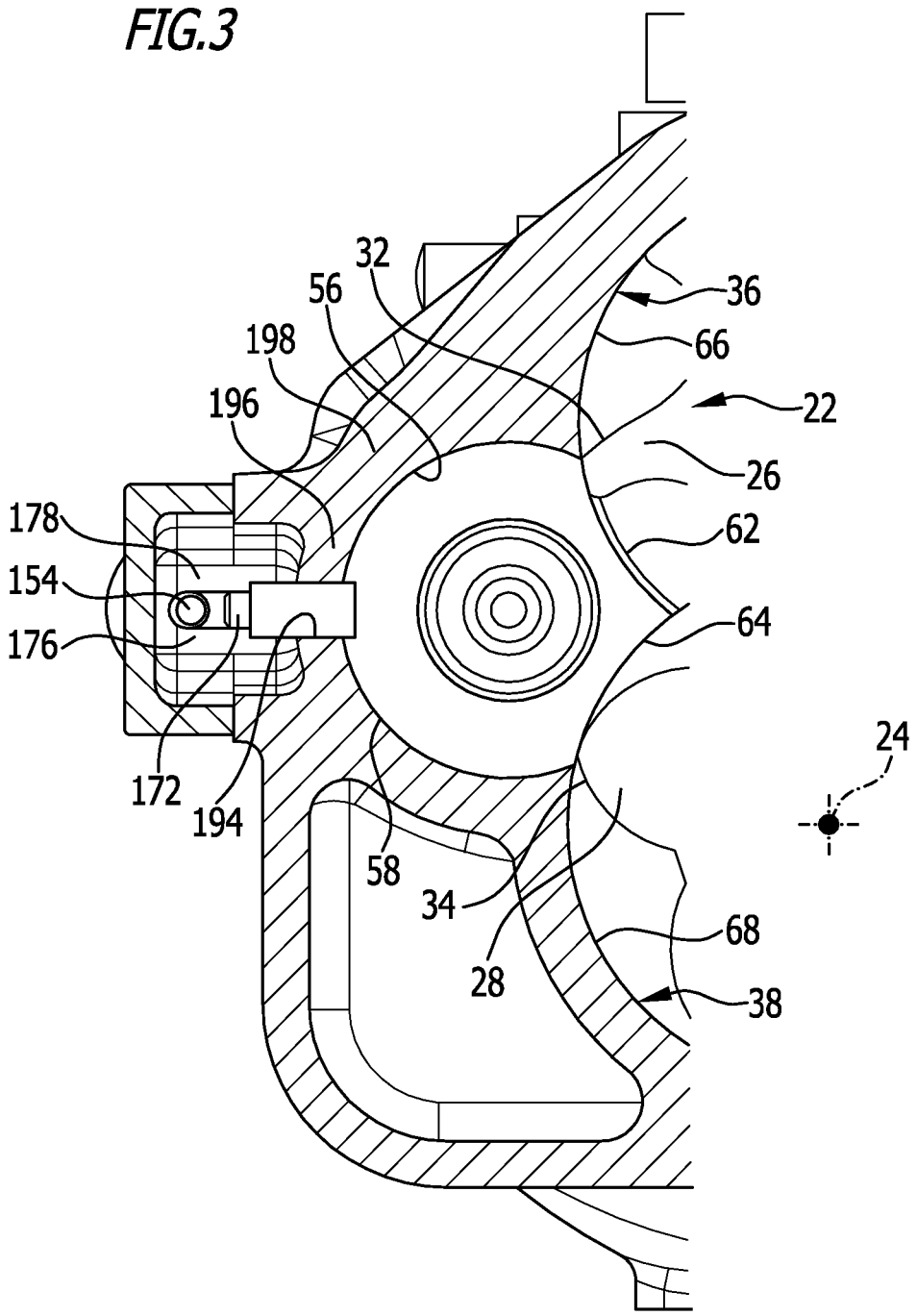
FIG. 3 shows a section along the line 3-3, in the region of a position determining device.

As illustrated in FIGS. 2 and 3, provided in a screw rotor chamber 18 of the compressor housing 12 are two screw rotors 26, 28 that are each rotatable about a respective screw rotor axis 22, 24 and engage in one another by means of their helical contours 32 and 34 and cooperate with compression wall surfaces 36 and 38 respectively of the screw rotor chamber 18 which are peripherally adjacent to the helical contours 32, 34, in order to receive gaseous medium that is supplied to a low-pressure chamber 42 adjacent to the helical contours 32, 34 on the intake side, to compress it and to discharge it at high pressure into a high-pressure chamber 44 in the compressor housing 12.

Here, the gaseous medium, in particular refrigerant, is enclosed in compression chambers, which are formed between the helical contours 32, 34 and the compression wall surfaces 36, 38 that are adjacent to the latter, with an intake volume at low pressure and is compressed to a final volume at high pressure.

For the purpose of adapting the screw compressor 10, for example to the operating conditions required in a refrigerant circuit, the operating state of the screw compressor 10 is adapted on the one hand in respect of the volume ratio, which is the relationship between the maximum enclosed intake volume and the expelled final volume, and on the other in respect of the compressor output, which is the proportion of the volumetric flow that is actually compressed by the screw compressor in relation to the maximum volumetric flow that is compressible by the screw compressor 10.

For the purpose of adapting the operating state, in a first exemplary embodiment that is illustrated in FIG. 2 to FIG. 8, a first control slider 52 and a second control slider 54 are arranged one behind the other in a slider channel 56 that is provided in the compressor housing 12, wherein the slider channel 56 extends parallel to the screw rotor axes 22, 24 and guides the first control slider 52 and the second control slider 54 in the region of their guide peripheral surface 58 that is not adjacent to the screw rotors 26, 28.

The first control slider 52 faces the high-pressure chamber 44 and is thus arranged on the high pressure side, and the second control slider 54 is arranged on the low pressure side in relation to the first control slider 52.

Each of the two control sliders 52 and 54 further has a slider compression wall surface 62 adjacent to the screw rotor 26, and a slider compression wall surface 64 adjacent to the screw rotor 28, which represent partial surfaces of the compression wall surfaces 36 and 38, and housing compression wall surfaces 66 and 68 formed by the compressor housing 12, which likewise represent partial surfaces of the compression wall surfaces 36 and 38, supplement the compression wall surfaces 36 and 38, which together with the helical contours 32 and 34 contribute to forming the compression chambers.

As illustrated in FIG. 2 and FIGS. 4 to 8, the first control slider 52 and the second control slider 54 take a form such that, to the extent that they form the slider compression wall surfaces 62 and 64 and the guide peripheral surface 58, they are identical and can thus be guided displaceably and in a direction of displacement 72 parallel to the screw rotor axes 22, 24, within the slider channel 56 of the compressor housing 12.

Here, the first control slider 52 forms an outlet edge 82, which faces the high-pressure chamber 44, establishes the final volume of the compression chambers, is displaceable by displacing the first control slider 52 in the direction of displacement 72 and, as a result of its position in relation to a terminal surface 84 of the screw rotor chamber 18 on the high pressure side, sets the final volume of the compression chambers that are formed and thus the volume ratio.

This principle of a slider arrangement is known and described for example in WO 93/18307, to which reference is made in respect of the description of the principle of functioning.

Figure 4:
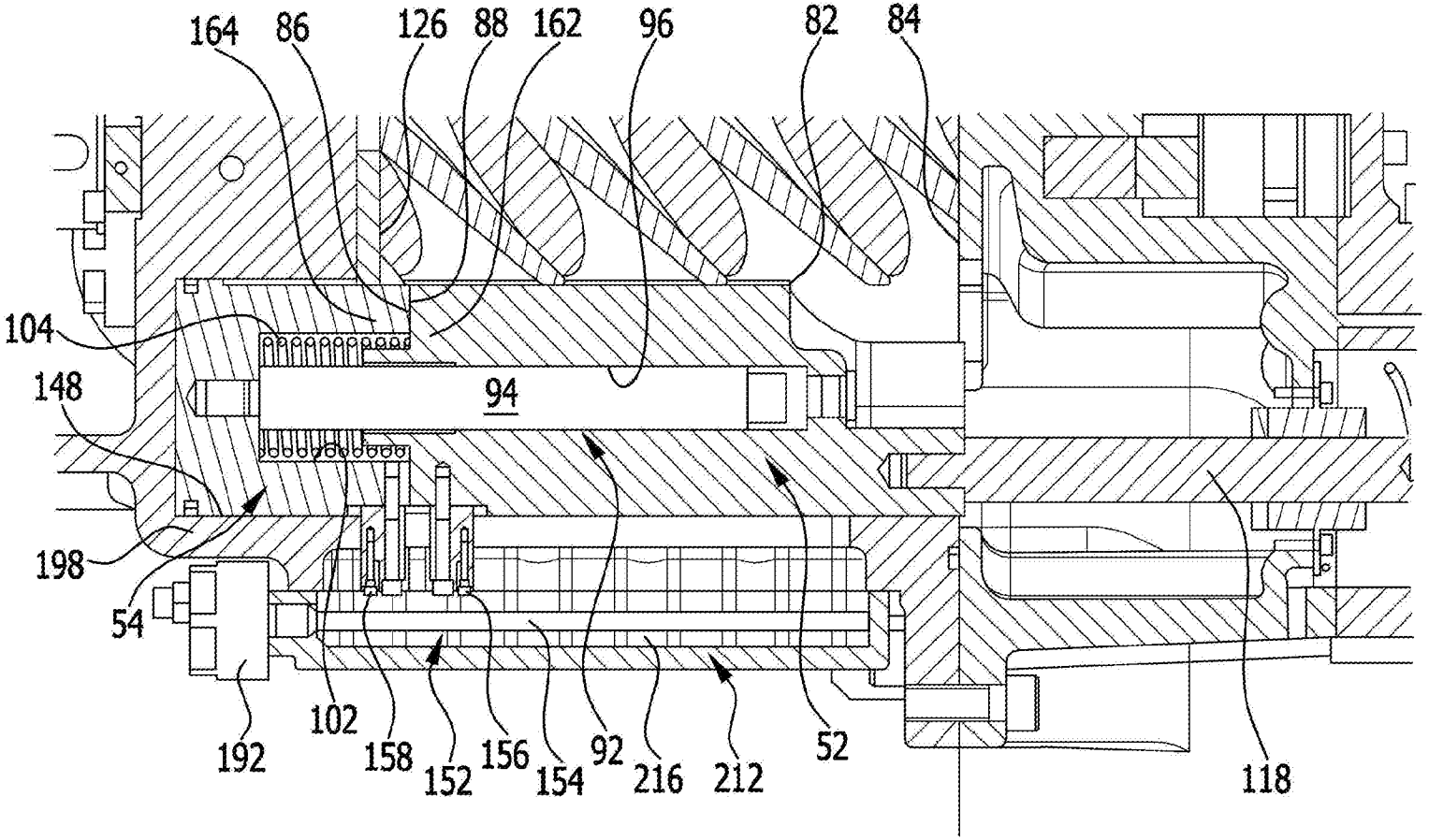
FIG. 4 shows a section similar to FIG. 2 and on a larger scale, in the region of the position determining device and the control sliders, with the maximum output and the minimum volume ratio.
Figure 5:
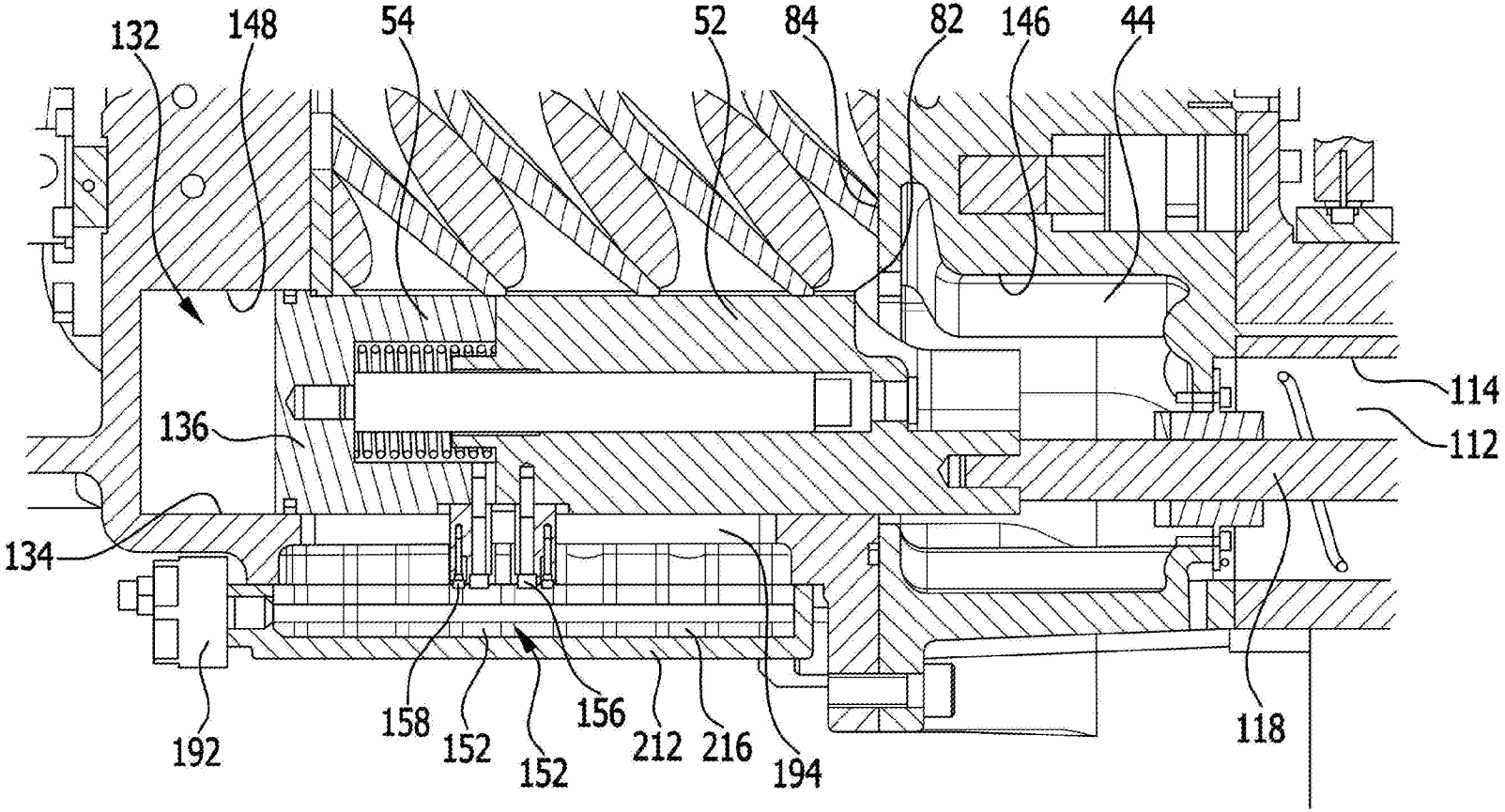
FIG. 5 shows an illustration similar to FIG. 4, with the maximum conveying volume and the maximum volume ratio.

As illustrated in FIG. 2 and FIGS. 4 to 8, the first control slider 52 and the second control slider 54 have mutually facing end surfaces 86 and 88 by means of which they are configured to abut against one another, as illustrated for example in FIG. 4 and FIG. 5, such that the slider compression wall surfaces 62 and 64 of the first control slider 52 and the second control slider 54 merge into one another.

Further, and in addition to the slider channel 56, the first control slider 52 and the second control slider 54 are guided in relation to one another by a telescopic guide 92 that has an inner guide body 94 and a guide receptacle 96, wherein the guide receptacle 96 is provided in the first control slider 52 and the guide body 94 is held on the second control slider 54 and projects beyond the end surface 88 thereof such that this can engage in the guide receptacle 96 in the first control slider 52.

Further, and preferably also in an inner chamber 102 of the second control slider 54 surrounding the guide body 94, a pressure spring 104 is provided that serves to urge the first control slider 52 in relation to the second control slider 54 such that the end surfaces 86 and 88 are movable away from one another.

For the purpose of displacing the first control slider 52 there is provided, as illustrated in FIG. 2, a cylinder arrangement 112 that includes a cylinder chamber 114 and a piston 116, wherein the piston 116 is connected to a piston rod 118 that makes a connection with the first control slider 52, for example with an extension 122 of the first control slider 52 that is arranged for example on an opposite side thereof to the end surface 86.

Further, the cylinder arrangement 112 is located in particular on an opposite side of the first control slider 52 to the second control slider 54, preferably in a housing portion 124 of the compressor housing 12 that is on the high pressure side and is arranged to succeed the slider channel 56 and to succeed the high-pressure chamber 44 and thus on an opposite side of the compressor housing 12 to the low-pressure chamber 42.

The second control slider 54 is displaceable by a cylinder arrangement 132 that includes a piston 136 which is movable in a cylinder chamber 134, wherein the cylinder chamber 134 extends in particular, as an extension of the slider channel 56, in a housing portion 142 that is on the low pressure side and in which there are arranged bearing units on the drive side for the screw rotors 26 and 28, which are for example drivable by way of a drive shaft 144.

In particular, the piston 136 is integrally formed in one piece with the second control slider 54 and has a piston surface that corresponds at least to the cross sectional surface area of the second control slider 54.

The housing portion 142 on the low pressure side, which receives the cylinder chamber 134 for the cylinder arrangement 132 for moving the second control slider 54, is located in a region of the compressor housing 12 that is arranged opposite the housing portion 124 on the high pressure side, for receiving the cylinder chamber 114 for the cylinder arrangement 112.

The first control slider 52 and the second control slider 54 can be pushed together by the cylinder arrangements 112 and 132 if the end surfaces 86 and 88 abut against one another in a combined position, and the two control sliders 52, 54 can also move together in the combined position, in the manner of a single control slider that extends from the terminal surface 126 on the intake side in the direction of the terminal surface 84 on the pressure side, and whereof the outlet edge 82 contributes to establishing the volume ratio, with the screw compressor 10 always conveying the maximum volumetric flow in this combined position, as illustrated in FIG. 4.

The volume ratio can be adjusted in dependence on the position of the outlet edge 82 in relation to the terminal surface 84, increasing as the spacing from the outlet edge 82 to the terminal surface 84 decreases, and reaches its maximum value when the outlet edge 82 has the least spacing from the terminal surface 84 that is required for minimising the final volume, as illustrated for example in FIG. 5.

Figure 6:
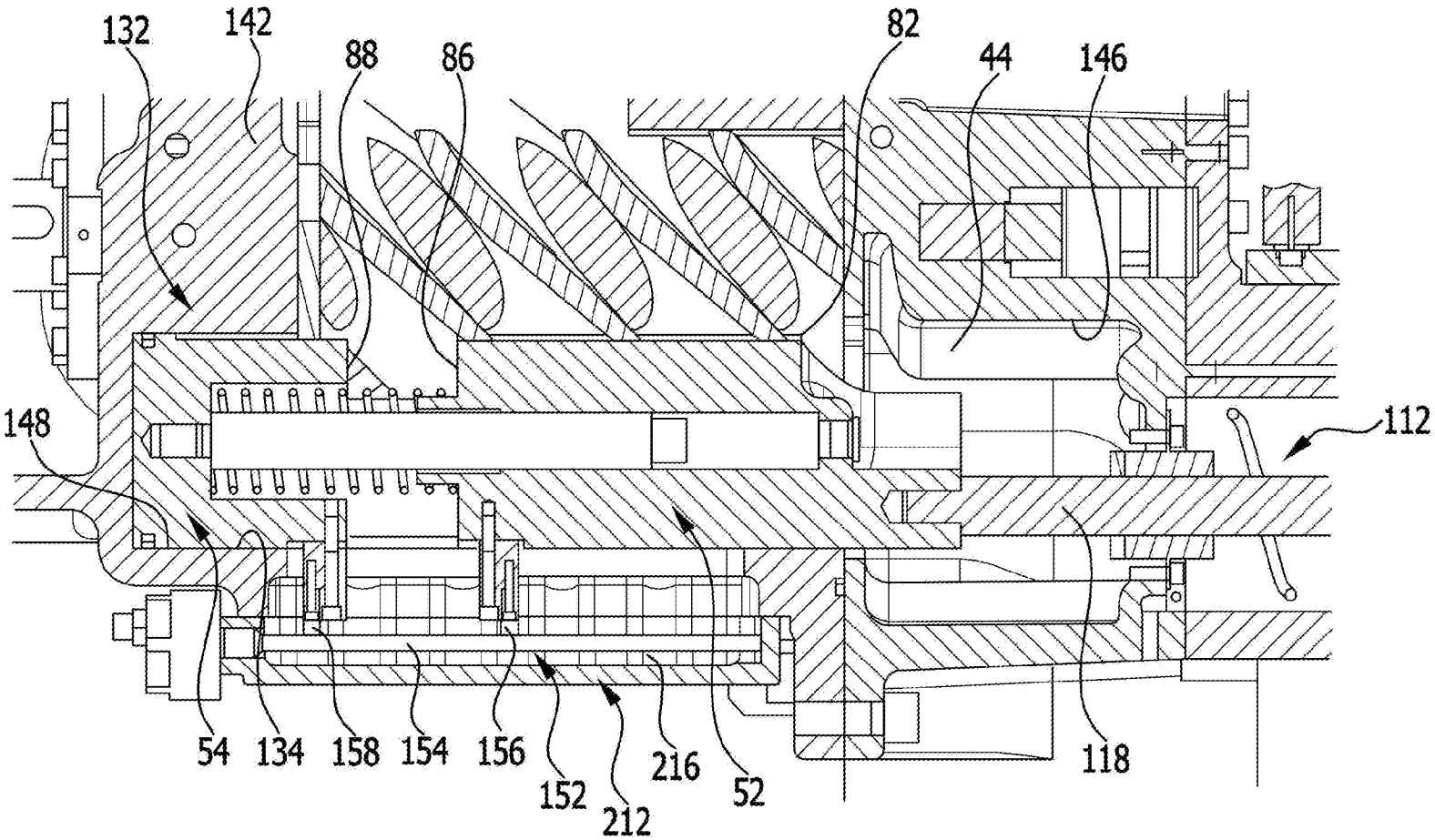
FIG. 6 shows an illustration similar to FIG. 4, with approximately three quarters of the output.

If the compressor output, that is to say the volumetric flow that is actually conveyed, is additionally to vary, then as illustrated for example in FIG. 6 the end surfaces 86 and 88 are separated by moving the control sliders 52 and 54 apart, into a separated position. In the separated position, the second control slider 54 is ineffective, so in the separated position the position of the end surface 86 of the first control slider 52 establishes the initial volume.

Provided the outlet edge 82 is not in a position in which it predetermines the minimum possible final volume, however, the relationship between the initial volume, predetermined by the end surface 86, and the final volume, predetermined by the outlet edge 82, is not variable.

Figure 7:
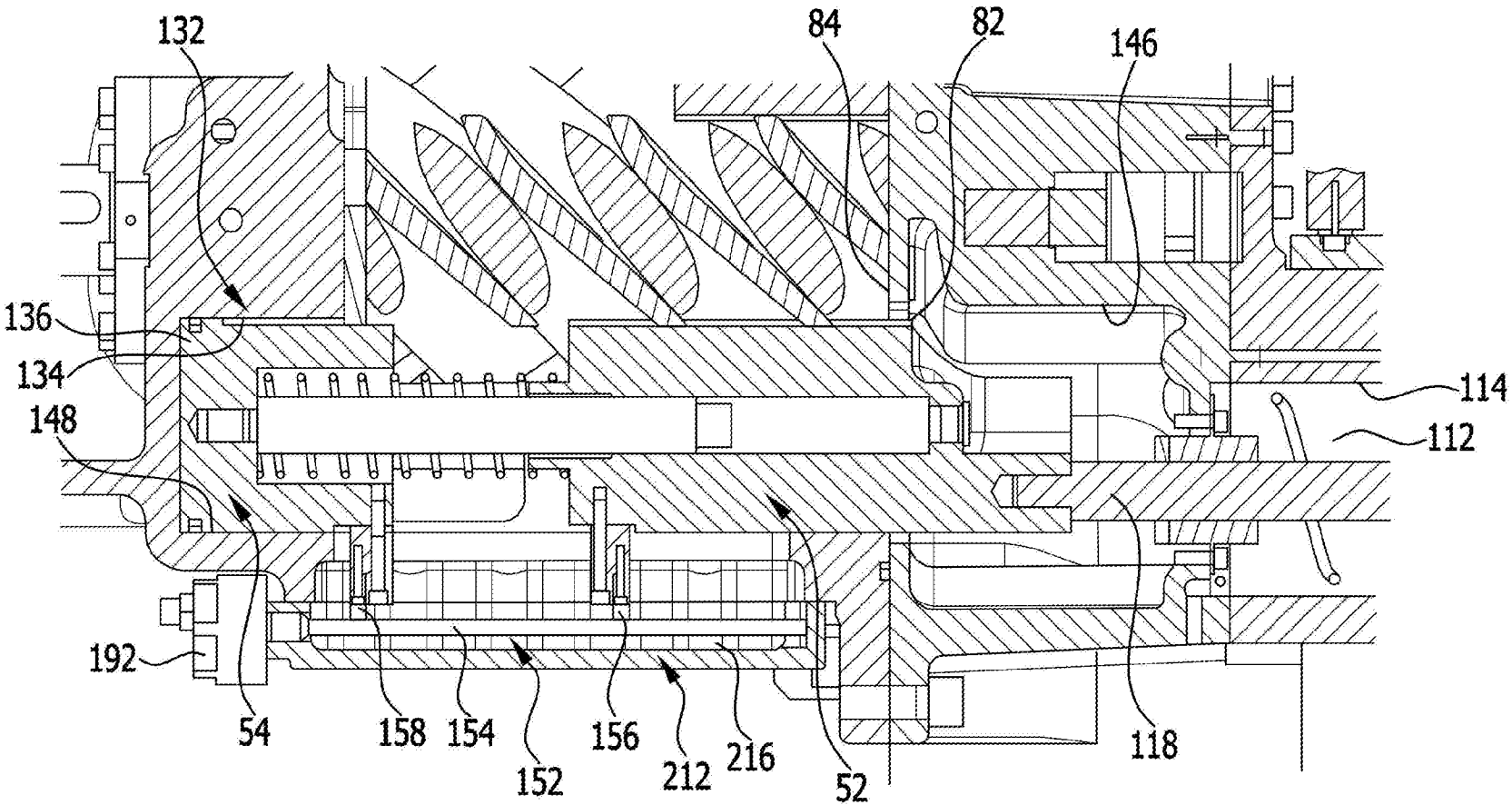
FIG. 7 shows an illustration similar to FIG. 4, with approximately half the output.

If, however, as illustrated in FIG. 7, the first control slider 52 is displaced far enough in the direction of the high-pressure chamber 44 for the outlet edge 82 to have the minimum spacing from the terminal surface 84 or even to be displaced beyond this into a retraction chamber 146, which is surrounded by the high-pressure chamber 44, for the first control slider 52, it is possible to vary the initial volume 86 without changing the final volume, since the latter then continues to remain at a minimum.

In order to eliminate the action of the second control slider 54 in the separated position, it is retracted into the housing portion 142 in particular by means of the cylinder arrangement 132, wherein the cylinder chamber 134 is dimensioned such that at the same time it includes a retraction chamber 148 for the second control slider 54 and thus provides the possibility of moving the second control slider 54 far enough away from the first control slider 52 for the end surface 88 no longer to affect the initial volume.

Thus, the second control slider 54 enables the initial volume to be affected either in that it abuts by means of its end surface 88 against the end surface 86 of the first control slider 52, for forming the combined position of the control sliders 52, 54, and thus maximises the initial volume, or it can be moved by means of its own end surface 88 far enough away from the end surface 86 of the first control slider 52 for there to be no further effect of any kind on the initial volume by the second control slider 54.

For determining the positions of the first control slider 52 and the second control slider 54, there is provided a position determining device which is designated 152 as a whole and includes a detector element 154 that extends parallel to the direction of displacement 72 of the control sliders 52, 54 and thus parallel to the screw rotor axes 22, 24, and which is able to determine the positions of position indicator elements 156 and 158.

Figure 9:
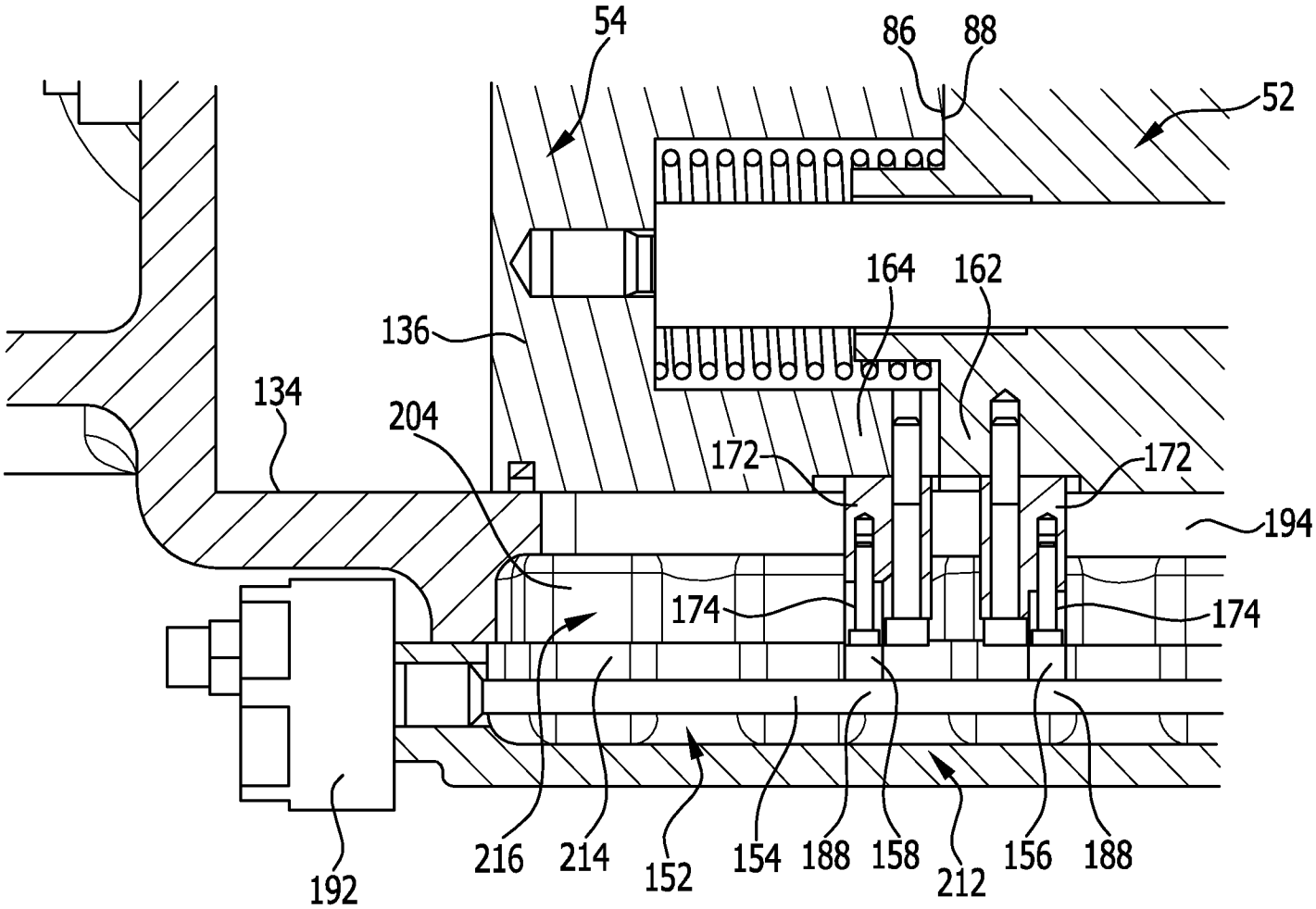
FIG. 9 shows an illustration, on a larger scale, of the position determining unit and the position indicator elements, in connection with the control slider.

Here, the position indicator element 156 is fixedly coupled to the first control slider 52, in particular to an end region 162 of the first control slider 52 that succeeds the end surface 86, and the position indicator element 158 is coupled to the second control slider 54, in particular to an end region 164 thereof that succeeds the end surface 88, as illustrated in particular in FIG. 9.

Figure 10:
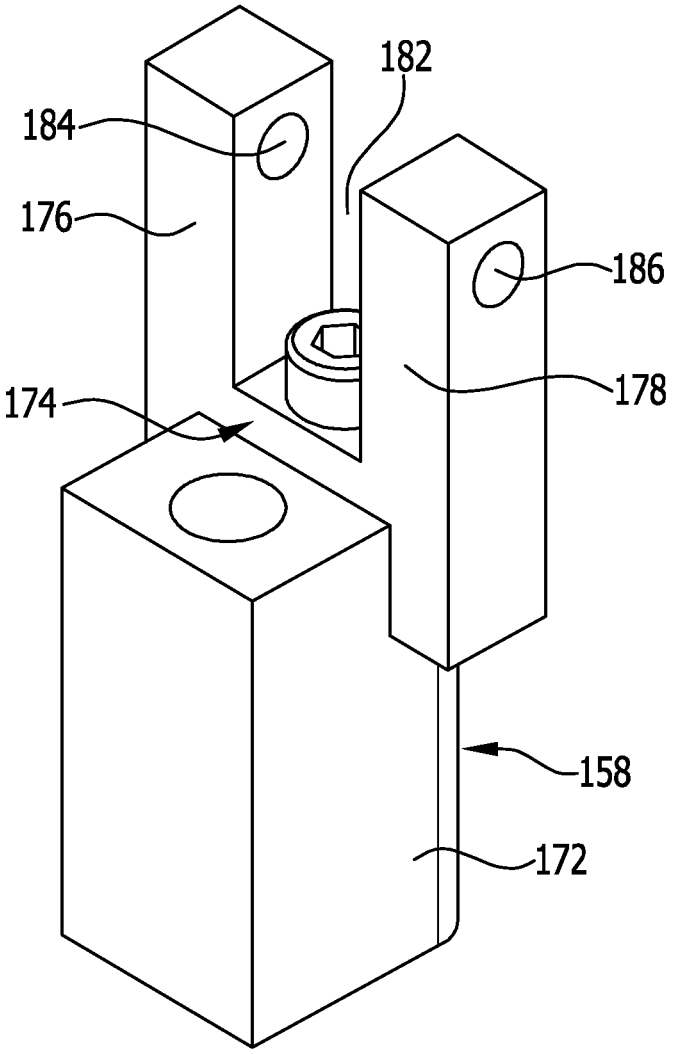
FIG. 10 shows a perspective illustration, on a larger scale, of a position indicator element of the position determining device.
Figure 11:
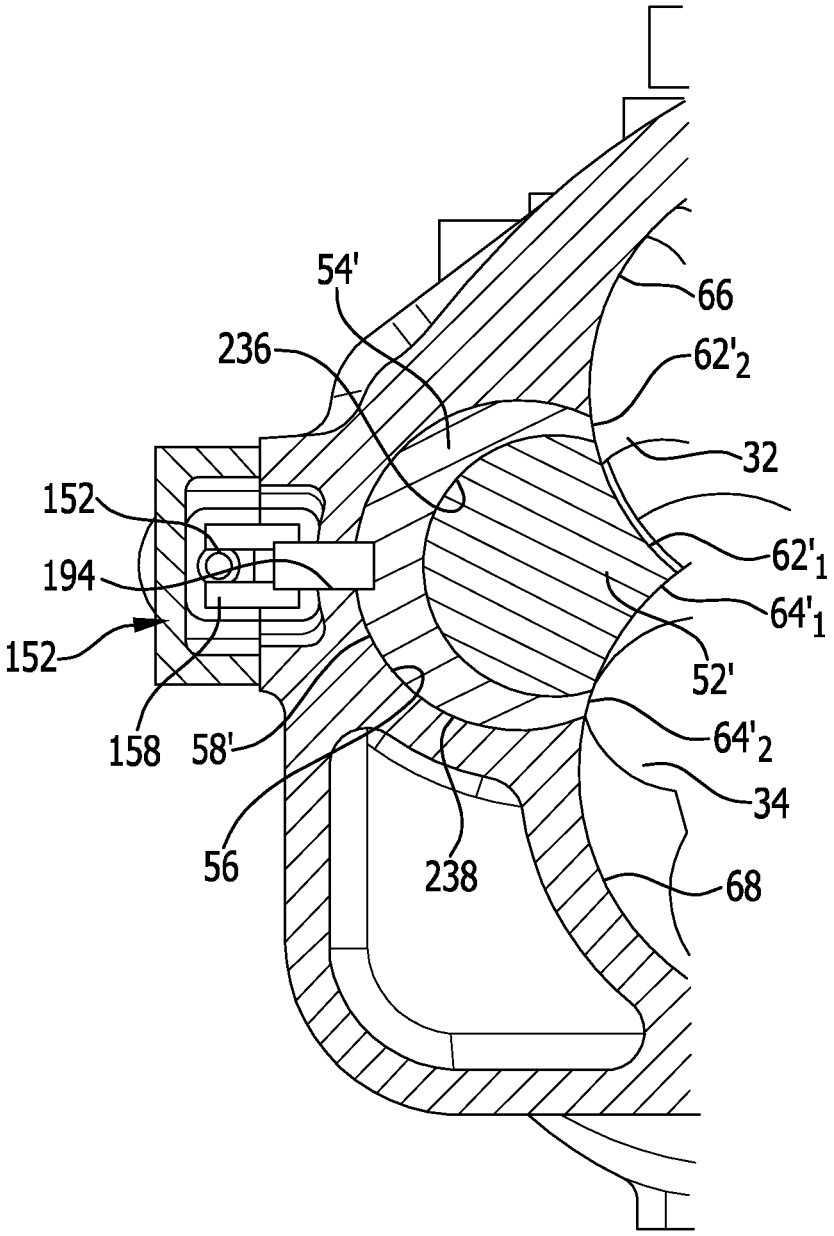
FIG. 11 shows a section similar to FIG. 3, through a second exemplary embodiment of a screw compressor according to the invention, with control sliders arranged within one another.
Figure 12:
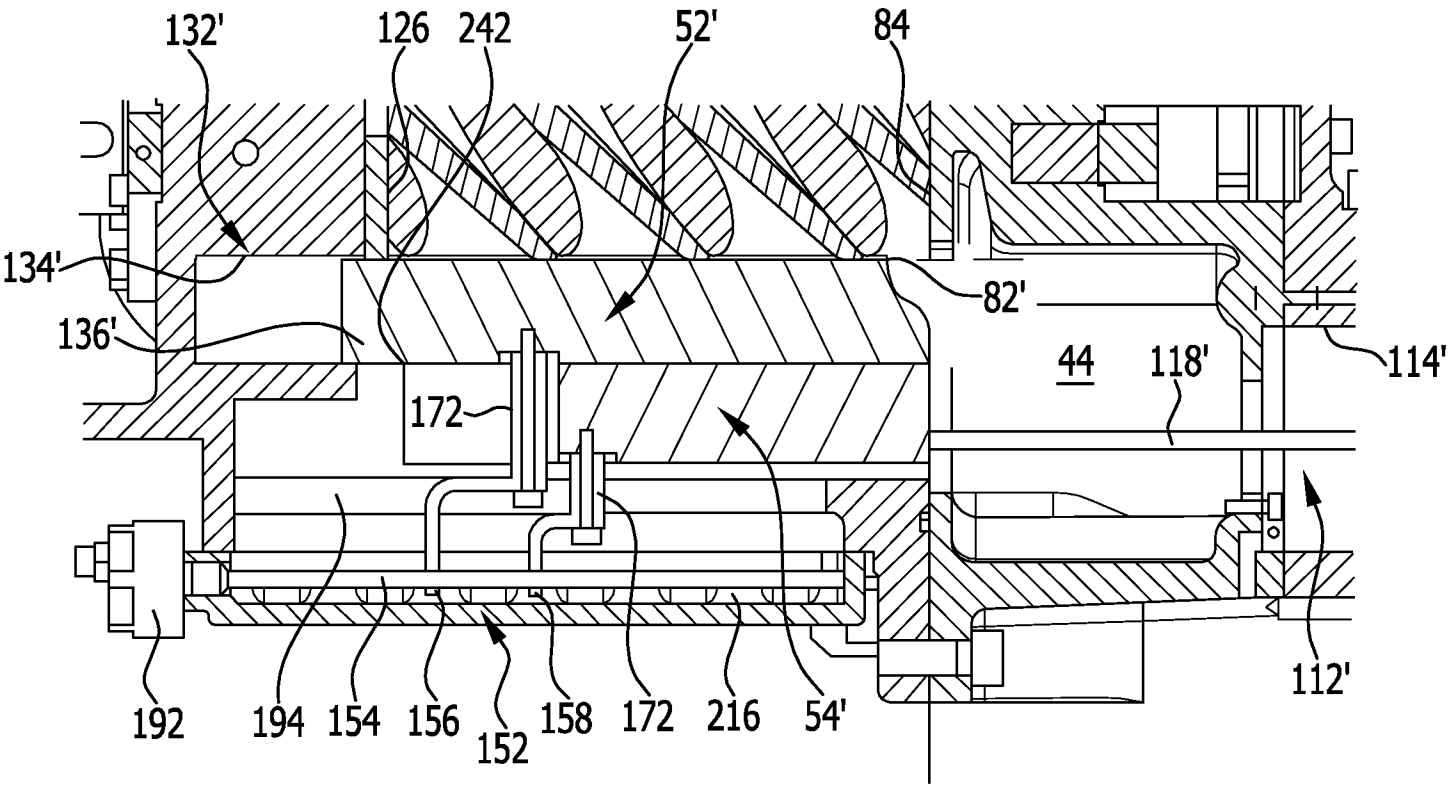
FIG. 12 shows a schematic illustration of the second exemplary embodiment of the screw compressor according to the invention, with control sliders arranged within one another in a manner similar to FIG. 4, with the maximum volume ratio and the maximum output.
Figure 13:
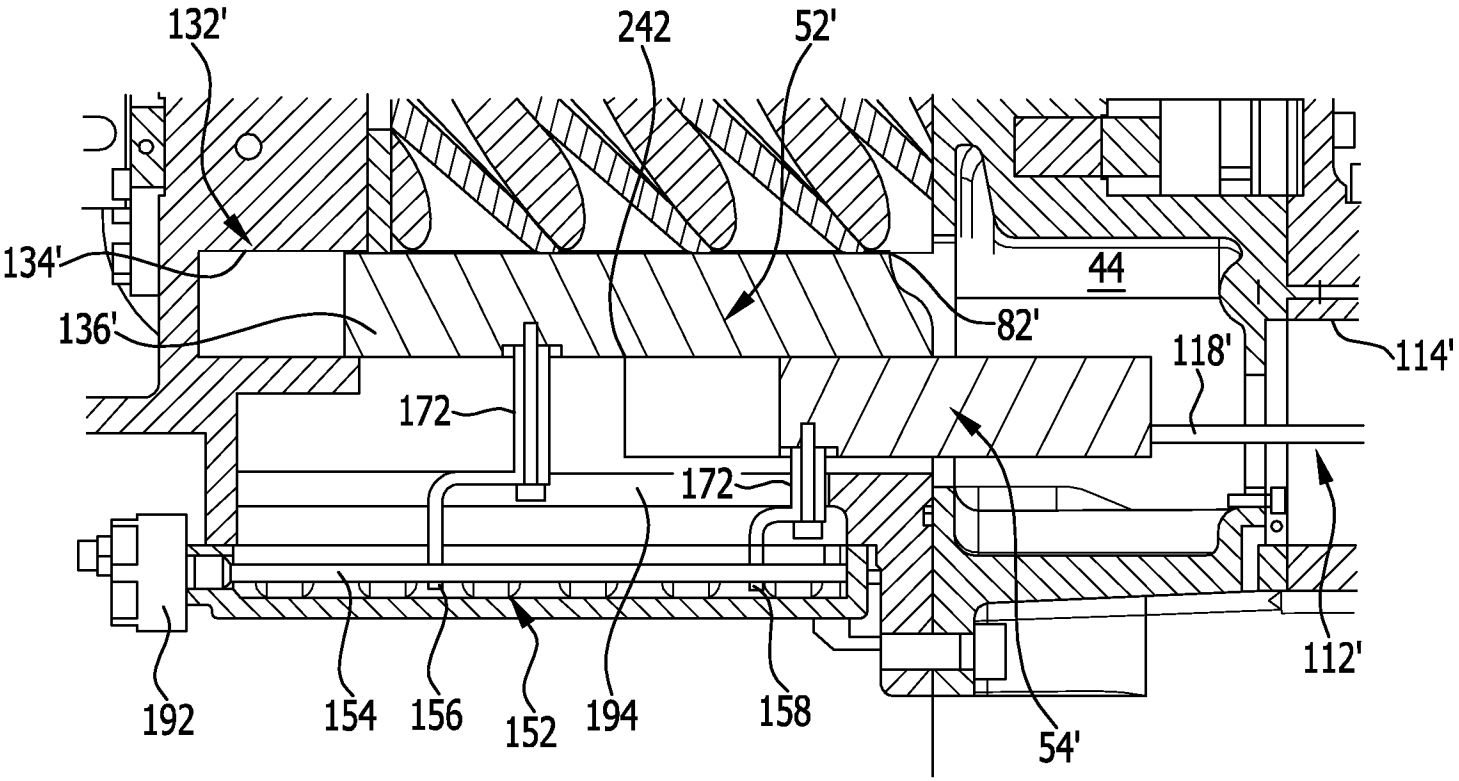
FIG. 13 shows an illustration similar to FIG. 12, with the maximum volume ratio and the minimum output.
Figure 14:
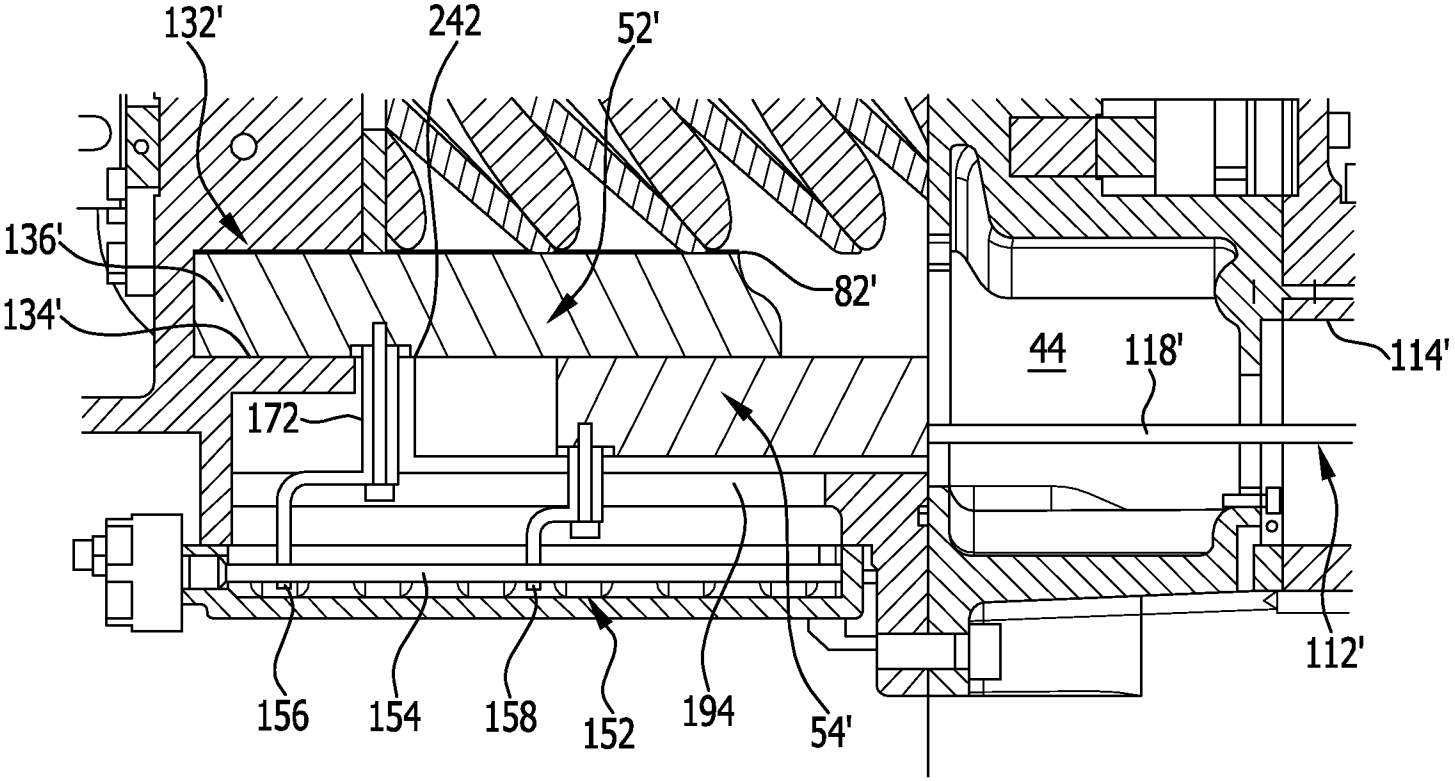
FIG. 14 shows an illustration similar to FIG. 12, with the minimum volume ratio and the maximum output.

As illustrated in FIG. 10, each of these position indicator elements 156 and 158 includes a forked element that is designated 174 as a whole and delimits by means of its two fork limbs 176 and 178 an intermediate space 182 that lies between them and through which the elongate detector element 154 extends. Each of these forked elements 174 is coupled to the corresponding control slider 52, 54 by way of a connecting body 172 that is connected to the respective end region 162 or 164.

Preferably, the fork limbs 176 and 178 carry magnets 184 and 186 respectively, whereof the magnetic field flows through the detector element 154 at the location of the magnets 184, 186.

Here, the detector element 154 is made from a magnetostrictive material, with the result that the respective location 188 of the magnetic flux of the detector element 154 from the magnets 184, 186 is determinable by means of an evaluation device that is designated 192 as a whole, wherein the evaluation device 192 generates for example in the magnetostrictive detector element 154 acoustic waves that are reflected back at the locations 188 through which the magnetic fields of the magnets 184, 186 flow, with the result that the evaluation device 192 can determine, from the transit time of the reflected acoustic waves, the position of the locations 188 at which there is magnetic flux through the magnetostrictive detector element 154.

Figure 8:
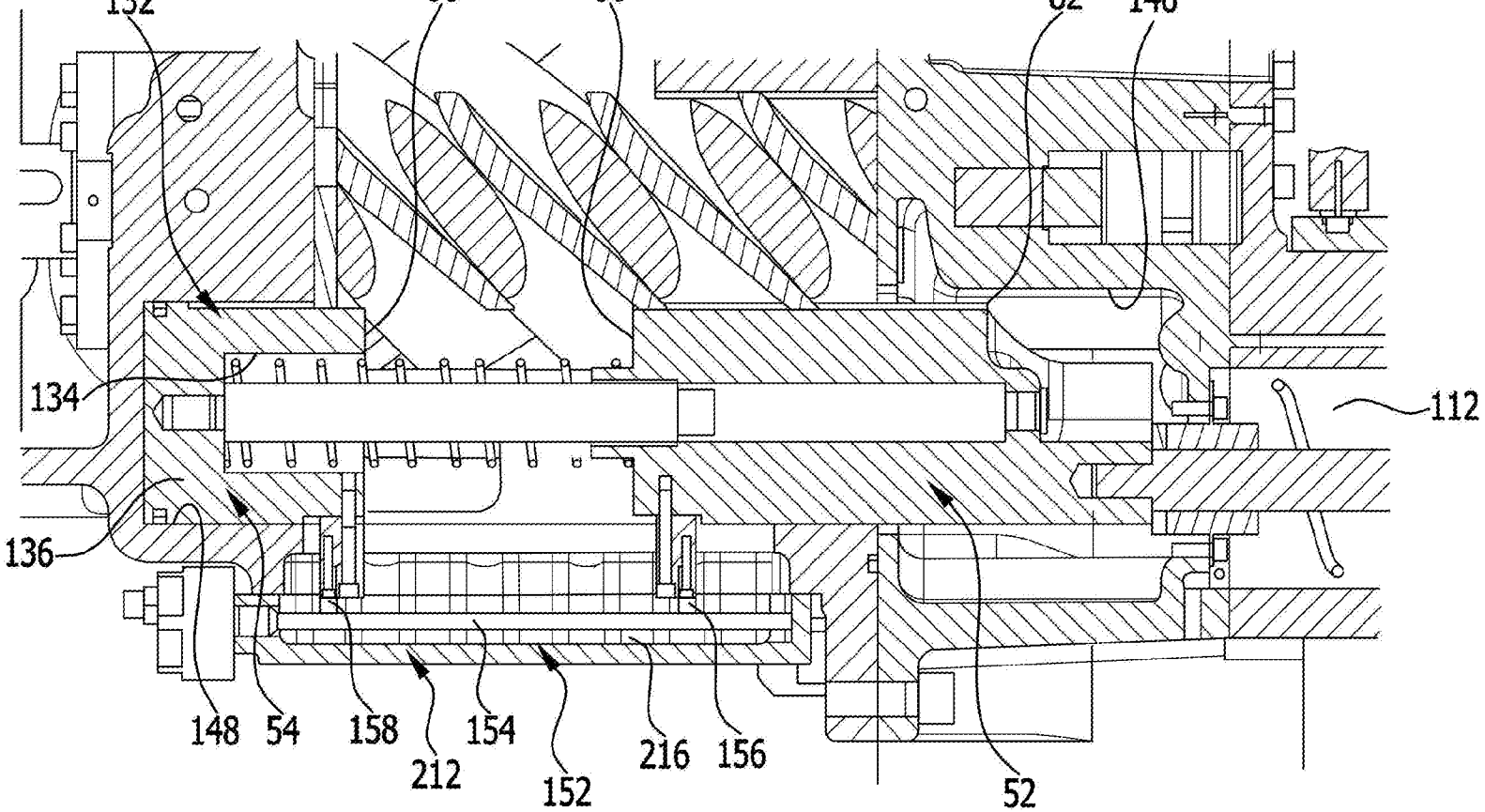
FIG. 8 shows an illustration similar to FIG. 4, with approximately a quarter of the output.

The connecting bodies 172, which are held at the respective end regions 162, 164 of the control sliders 52, 54, pass through an elongate, slot-shaped passage 194 which is made in a housing wall 196 forming the slider channel 56 and which has a length that, in the separated position, allows the second control slider 54 to be retracted entirely into the retraction chamber 148 and the first control slider 52 to be positioned with a minimum initial volume, that is to say in a position according to FIG. 8, and the first control slider 52 to be positioned with a minimum volume ratio, that is to say with a maximum spacing of the outlet edge 82 from the terminal surface 84 on the pressure side, and moreover, in the combined position, allows the second control slider 54 to be positioned with the first control slider 52, with maximum volume ratio and minimum volume ratio.

Together with the slot-shaped passage 194, each connecting body 172 that is connected to the respective end region 162 and 164 of the corresponding control slider 52 and 54 forms an element preventing rotation of the respective control slide 52, 54, similar to guidance through a groove block and a groove, with the result that there is no need to provide grooves in the control sliders 52, 54 that cooperate with groove blocks projecting into the slider channel 56.

The passage 194 is always kept at the pressure in the low-pressure chamber 42, and thus also serves to keep the control sliders 52, 54 abutting by means of their guide peripheral surface 58 against the slider channel 56, with the result that the control sliders 52, 54 cannot press against the screw rotors 26, 28 by means of the slider compression wall surfaces 62, 64 as a result of the high pressure prevailing between the slider channel 56 and the guide peripheral surface 58.

Here, sealing of the passage 194 from relatively high pressures, in particular also the high pressure, is brought about by the narrow tolerance of the gap between the slider channel 56 and the guide peripheral surface 58 of the control sliders 52, 54.

For receiving the forked elements 174 and the detector element 154, there is provided, on an opposite side of a wall 196 of a housing base body 198 to the slider channel 56, a recess 204 that is covered by a cover 212 which itself has a recess 214 facing the recess 204, with the result that the recesses 204 and 214 supplement one another and thus form for example an elongate detector channel 216 which extends parallel to the direction of displacement 72 and in which the detector element 154 extends on the one hand and the forked elements 174 are movable on the other, wherein the forked elements 174 embrace the detector element 154 on both sides by means of their fork limbs 176, 178 and position the magnets 184, 186 such that the magnetic field thereof flows through the detector element 154 at a respective particular location 188.

Preferably, the cover 212 takes a form such that the detector element 154 is located in its recess 214, with the result that the detector element 154, together with the evaluation device 192, is held exclusively on the cover 212 and is removable therewith, whereas the forked elements 174 extend in the detector channel 216, in particular both in the recess 214 and in the recess 204.

For the purpose of moving the control sliders 52 and 54 into the positions provided therefor, as illustrated in FIG. 2 there is provided a controller 218 which, as a result of the connection with the position determining device 152, is able to determine the actual positions of the control sliders 52, 54.

Using the controller 218, the cylinder arrangements 112 and 132 are controllable in order to position the control sliders 52, 54, as illustrated in FIGS. 1 and 2.

For this purpose, solenoid valves ML1 and ML2 for example are controllable in order to control the cylinder arrangement 112, and solenoid valves MV1 and MV2 are controllable in order to control the cylinder arrangement 132.

This provides the possibility of positioning the control sliders 52, 54 in a position-controlled manner using the controller 218, that is to say of precisely moving to and maintaining the positions of the control sliders 52, 54 that are predetermined for example by a compressor control program.

A compressor control program of this kind runs for example on a higher-level compressor controller.

In the exemplary embodiment illustrated, this compressor control program is integrated into the controller 218, with the application limits of the screw compressor 10 and the parameters of the gaseous medium, that is to say in particular the refrigerant, in particular being known, and determines for example the low pressure by way of a pressure sensor SPN (FIG. 2), the high pressure by way of a pressure sensor SPH (FIG. 1), the temperature of the gaseous medium on the high pressure side by way of a temperature sensor STH (FIG. 2), and the temperature of the gaseous medium on the low pressure side by way of a temperature sensor STN.

Moreover, it is possible in particular for the controller 218 to determine operating parameters of an in particular electrical drive motor (not illustrated) in respect of speed of rotation, power consumption, voltage and temperature.

Moreover, the controller 218 may in particular also determine a lubricant pressure, a lubricant flow, a lubricant level and a lubricant temperature.

Further, the required compressor output, for example for the refrigeration unit in which the screw compressor 10 is operating, is in particular also predetermined for the controller 218 by an external signal.

From some selected values among these, in particular from the information on the gaseous medium, for example on the refrigerant, on pressure and temperature on the high pressure side and the low pressure side and on the speed of rotation of the screw rotors 26, 28, or from further of these values mentioned above, it is possible using the controller 218 with the compressor control program for the respective operating state for an optimum position of the control sliders 52, 54 to be determined and adopted in a position-controlled manner.

In a second exemplary embodiment of a screw compressor according to the invention, the control sliders 52 and 54 take a different form, as illustrated in FIGS. 11 to 14.

In this exemplary embodiment, the second control slider 54' is located in the slider channel 56 and is guided therein by means of its guide peripheral surface 58'. Further, the second control slider 54' forms external slider compression wall surfaces $\mathbf{62'}_2$ and $\mathbf{64'}_2$ that directly succeed the housing compression wall surfaces 66 and 68, wherein the slider compression wall surface $\mathbf{62'}_2$ is adjacent to the screw rotor 26 and the slider compression wall surface $\mathbf{64'}_2$ is adjacent to the screw rotor 28.

The second control slider 54' in this case takes the form of a crescent moon shape in cross section, with the result that it itself forms a slider channel 236 in which the first control slider 52' is guided by means of its guide peripheral surface 238.

The first control slider 52' itself forms slider compression wall surfaces $\mathbf{62'}_1$ and $\mathbf{64'}_1$ that are located between the slider compression wall surfaces $\mathbf{62'}_2$ and $\mathbf{64'}_2$ and are directly succeeded by the slider compression wall surfaces $\mathbf{62'}_2$ and $\mathbf{64'}_2$, with the result that the slider compression wall surface $\mathbf{62'}_1$ is adjacent to the screw rotor 26 and the slider compression wall surface $\mathbf{64'}_1$ is adjacent to the screw rotor 28.

In this way, the slider compression wall surfaces $\mathbf{62'}_2$ and $\mathbf{64'}_2$ of the second control slider 54' and the sliding compression wall surfaces $\mathbf{62'}_1$ and $\mathbf{64'}_1$ of the first control slider 52' supplement the housing compression wall surfaces 66 and 68 to give the compression wall surfaces 36 and 38 that are arranged surrounding the helical contours 32 and 34 respectively.

The first control slider 52' further forms the outlet edge 82', which is arranged facing the high-pressure chamber 44 and establishes the final volume by its spacing from the terminal surface 84, in a manner comparable to the case in the first exemplary embodiment.

The second control slider 54' affects the initial volume by the position of inlet edges 242 of the slider compression wall surfaces $\mathbf{62'}_2$ and $\mathbf{64'}_2$, in particular the spacing thereof from the terminal surface 126 on the low pressure side.

In this exemplary embodiment, the first control slider 52' is controllable by a cylinder arrangement 132' that is arranged in particular on the intake side, wherein the piston 136' is in this case integrally formed in one piece with the first control slider 52' and is movable in the cylinder chamber 134', while the second control slider 54' is controllable by a cylinder arrangement 112' that is arranged in particular on the pressure side.

A slider arrangement of this kind is known and described for example in DE 32 21 849 A1, to which reference is made in respect of the description of the principle of functioning.

In the same way as in the first exemplary embodiment, the positions of the first control slider 52' and the second control slider 54' are determinable by the position determining device 152, wherein likewise position indicator elements 156 and 158 are coupled to the first control slider 52' and the second control slider 54' respectively by way of connecting bodies 172 that are fixedly connected to these control sliders 52' and 54' and, in the same way as in the first exemplary embodiment, pass through the passage 194 such that the position indicator elements 156 and 158 are movable along the detector element 154 in the detector channel 216 and, in the same way as in the first exemplary embodiment, the positions of the position indicator elements 156 and 158 may be determined by way of the evaluation device 192.

Here, preferably the position indicator elements 156 and 158 take the form of forked elements 174, in the same way as in the first exemplary embodiment, and are provided with magnets 184 and 186.

Otherwise, in the second exemplary embodiment all the elements that are identical with those of the first exemplary embodiment are provided with the same reference numerals, with the result that reference may be made in this regard to the statements made in respect of the first exemplary embodiment in their entirety.

In a third exemplary embodiment, which is in principle a variant of the first exemplary embodiment and is illustrated in FIGS. 15 to 18, the telescopic guide 92" that acts between the first control slider 52 and the second control slider 54 takes a form such that the inner guide body 94" is fixedly connected to the second control slider 54, in particular being screwed by means of a threaded pin 222 into a threaded bore 224 in the piston 136, and extends parallel to the direction of displacement 72.

In particular, this has the effect that the inner guide body 94" is arranged rigidly in relation to the piston 136 and forms by means of its peripheral surfaces 226 a guide, oriented parallel to the direction of displacement 72, for the first control slider 52.

In order to guide the first control slider 52 with precision in relation to the second control slider 54, the first control slider 52 is provided, in the region of the guide receptacle 96" for the guide body 94", with a guide bushing that is designated 232 as a whole and is guided with precision on the peripheral surface 226 of the guide body 94".

Preferably in this case, the guide bushing 232 is arranged at an end 234 of the guide body 94" that faces the piston 136 of the second control slider 54, with the result that, in all positions of the first control slider 52 in relation to the second control slider 54, the guide bushing 232 is guided at the minimum possible distance from the piston 136.

In particular, the guide bushing 232 extends over only a part of the extent of the guide receptacle 96" parallel to the direction of displacement 72, preferably only over less than half and, better, over less than a quarter of the extent of the guide receptacle 96" in the direction of displacement 72.

Figure 18:
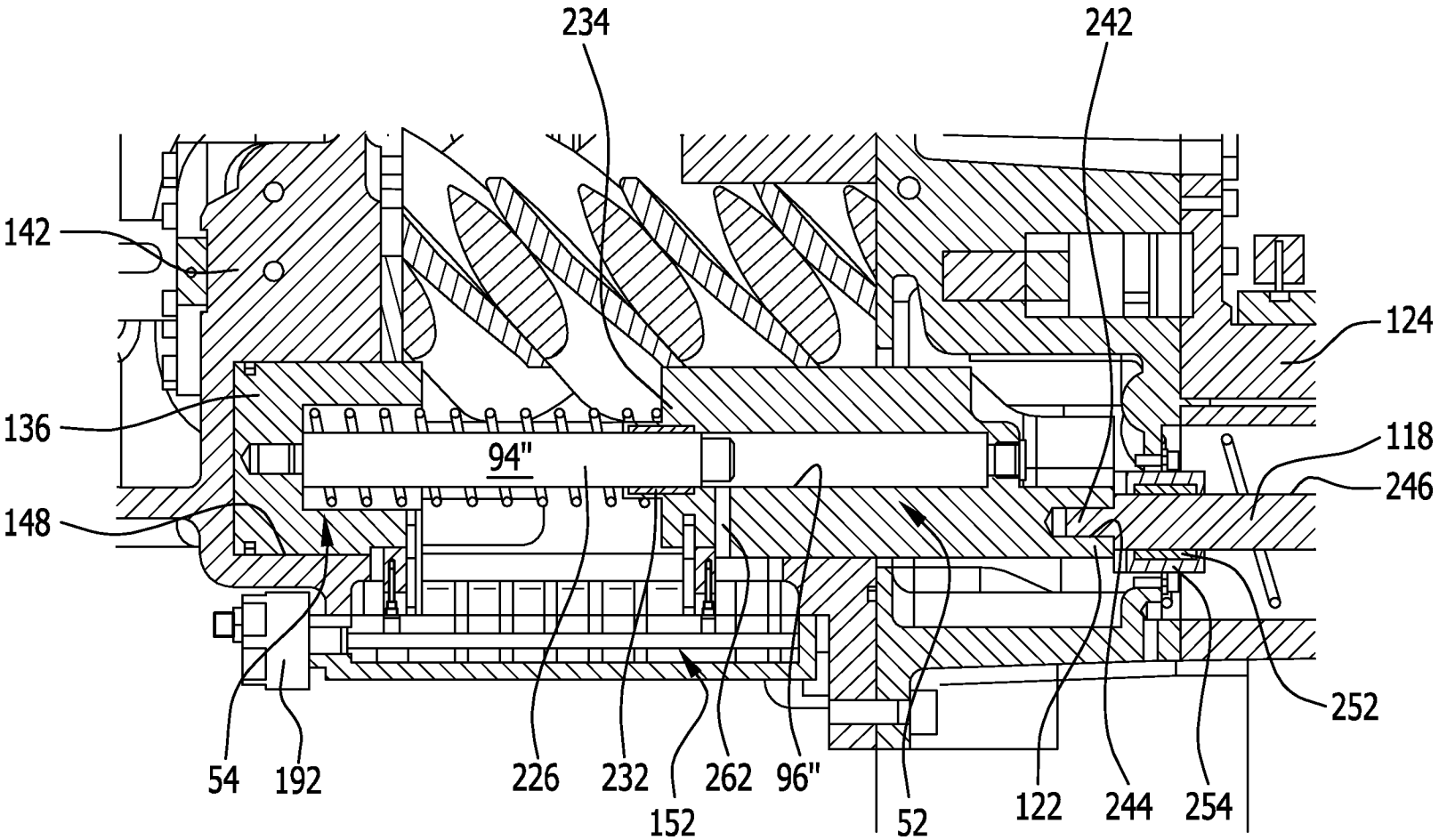
FIG. 18 shows a section similar to FIG. 8, through the third exemplary embodiment of the control slider according to the invention.

In this way, the first control slider 52 is guided with precision in relation to the second control slider 54 exclusively by way of the inner guide body 94" and the guide bushing 232 that slides on the peripheral surface 226 thereof, with the result that, as illustrated in FIG. 18, for example in the position with a partial load of 25%, the first control slider 52 continues to be guided with precision in relation to the second control slider 54 by the inner guide body 94" and the guide bushing 232, and the second control slider 54 itself undergoes precise guidance in relation to the housing portion 142 by being guided by the piston 136 in the retraction chamber 148.

Figure 15:
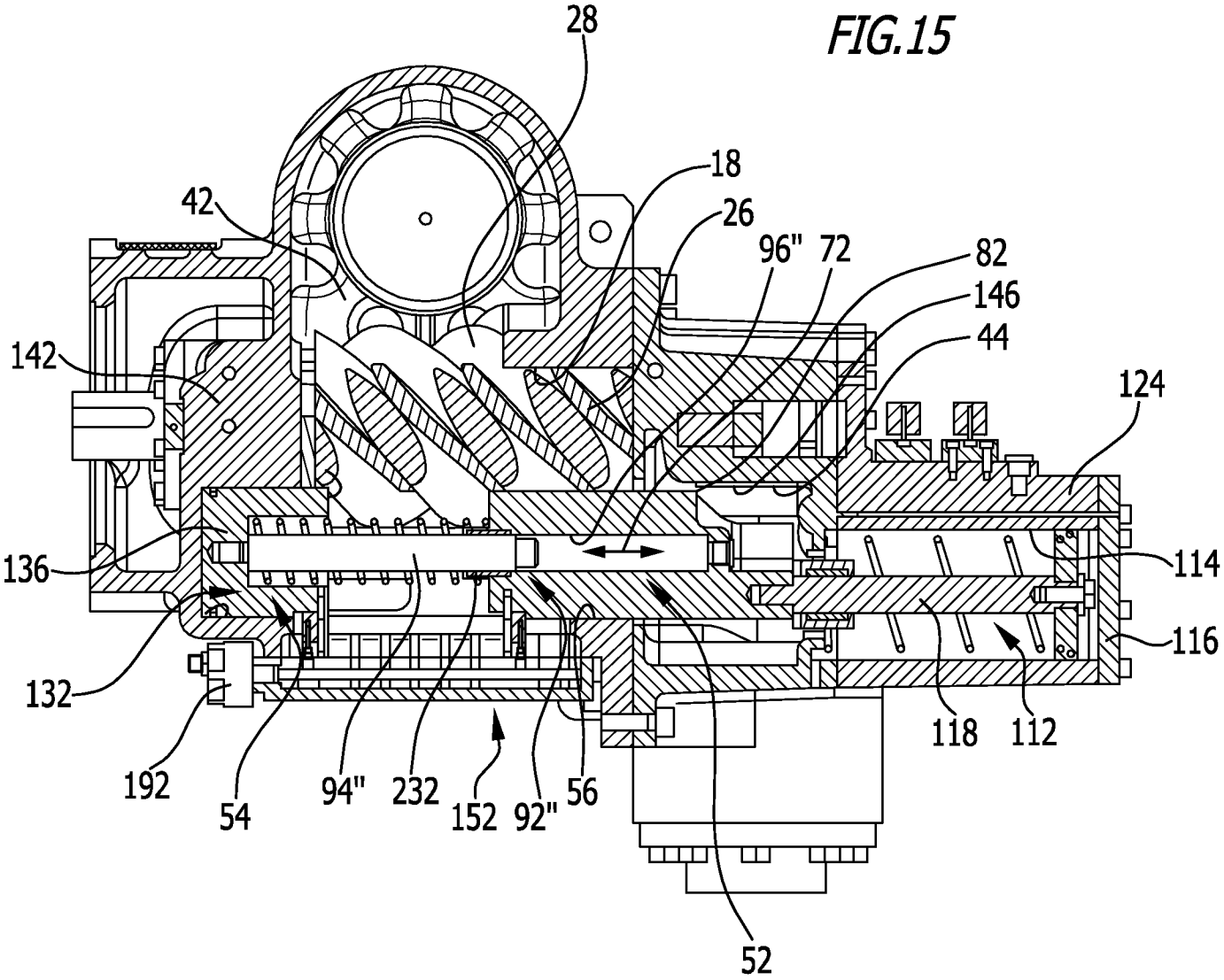
FIG. 15 shows a section similar to FIG. 2, through a third exemplary embodiment of a screw compressor according to the invention.
Figure 16:
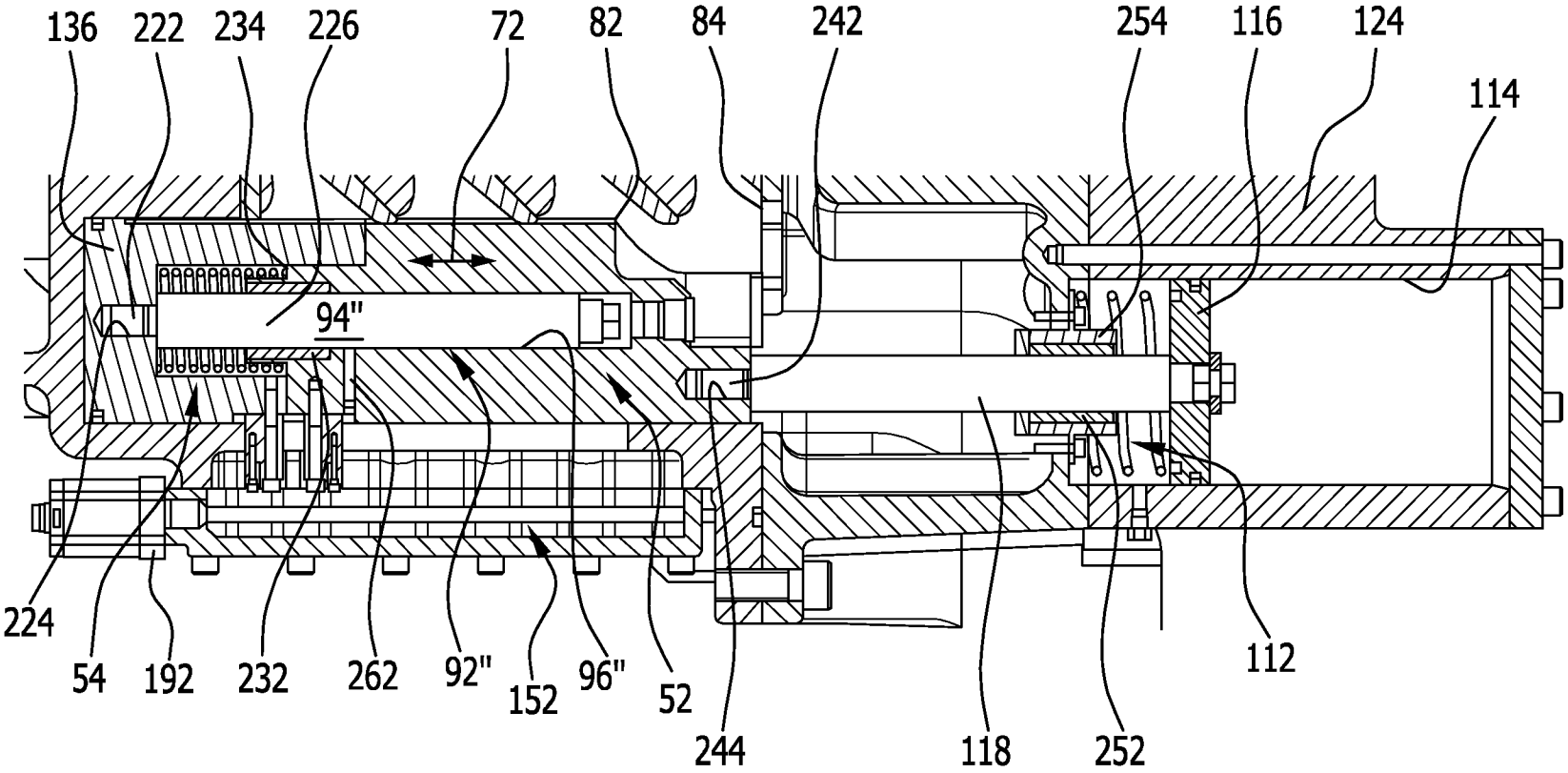
FIG. 16 shows a section similar to FIG. 4, through the third exemplary embodiment of the screw compressor according to the invention.

Moreover, the first control slider 52, as illustrated in FIGS. 15, 16 and 18, is preferably rigidly connected to the piston rod 118, which likewise engages for example by means of a threaded pin 242 in a threaded bore 244 in the first control slider 52, with the result that in this way the piston rod 118 is likewise rigidly fixed in relation to the first control slider 52.

In particular, the threaded bore 244 for the threaded pin 242 is seated in the extension 122 of the first control slider 52.

Further, the piston rod 118 is provided with a peripheral surface 246 that extends parallel to the direction of displacement 72 and is guided slidably in a guide bushing 252 which is itself seated in a guide bushing receptacle 254 that is fixedly connected to the housing portion 142 on the low pressure side and the housing portion 124 on the high pressure side.

Here, the guide bushing 252 is the sole device for precise guidance of the piston rod 118 in relation to the housing portions 142 and 124, and is thus a device for precise guidance of the first control slider 52 in relation to the housing portions 142, 124, which is performed in addition to guidance of the first control slider 52 in the slider channel 56.

As a whole, in this way the first control slider 52, which is guided with play in the slider channel 56, is thus additionally guided by the telescopic guide 92", formed by the guide bushing 232 and the inner guide body 94" that is rigidly connected to the second control slider 54, and moreover guided by the precise guidance of the piston rod 118 by means of the guide bushing 252 in relation to the housing portions 142 and 124, with the result that noise that may be generated during operation of the screw compressor according to the invention by the play when the first control slider 52 is guided in the slider channel 56, in particular a rattling, can be avoided because the telescopic guide 92" and guidance of the piston rod 118 by means of the guide bushing 252 have a smaller play than that of the first control slider 52 in the slider channel 56, and thus guidance of the first control slider 52 can be improved.

Because the guide bushing 232 slides on the peripheral surface 226 of the inner guide body 94" with a narrow tolerance, it is necessary to ventilate the guide receptacle 96".

Figure 17:
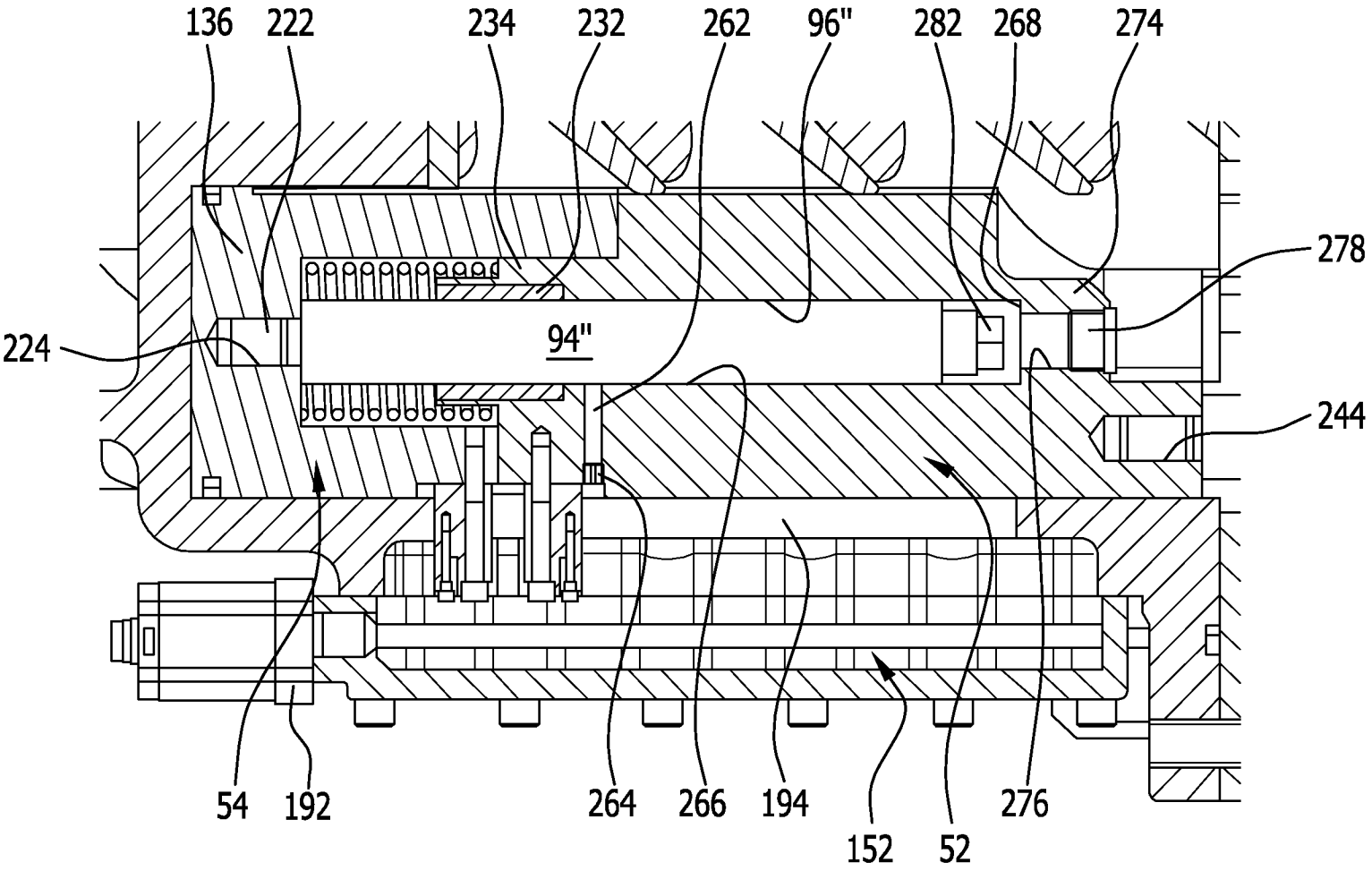
FIG. 17 shows an illustration, on a larger scale, of the first and the second control slider according to FIG. 16.

For this reason, as illustrated in FIG. 17, the guide receptacle 96" is provided with a ventilation channel 262 that opens into the guide receptacle 96", for example close to the guide bushing 232, and extends from the guide receptacle 96" in the direction of the guide peripheral surface 58 remote from the slider compression wall surfaces 62, 64, for example in the direction of the slot-shaped passage 194, with the result that advantageously an unhindered gas exchange can take place between the guide receptacle 96" and the pressurised chamber for receiving the position determining device 152.

Preferably, the ventilation channel 262 is also provided with an installed throttle 264 that allows the gas exchange between the guide receptacle 96" and the chamber for receiving the position determining device 152 to be controlled, in order in this way to damp the movements of the first control slider 52 in relation to the guide body 94".

Here, the ventilation channel 262 preferably opens into a portion 266 of the guide body receptacle 96" that lies between the guide bushing 232 and a terminal wall 268 of the guide receptacle 96".

For simple assembly of the guide body 94", in particular for screwing the threaded pin 222 into the threaded bore 224, the first control slider 52 is provided, in the region of the opposite end 274 thereof to the end 234, with a bore 276 that enables access to the guide receptacle 96" and is preferably arranged coaxially in relation to the guide receptacle 96" but is closed to be gas-tight during operation by a closure 278, for example a plug screwed into the bore 276.

However, during assembly of the guide body 94", in particular during screwing of the threaded pin 222 into the threaded bore 224, the bore 276 allows engagement in the guide receptacle 96" by means of a tool from the end 274 and rotation of the guide body 94" by means of a positively locking element 282 that is arranged on an opposite end of the guide body 94" to the threaded pin 222, in order to screw the threaded pin 222 into the threaded bore 224. Thereafter, the bore 276 is closed by the closure 278.

Otherwise, all the elements that are identical to those of the exemplary embodiments above are provided with the same reference numerals, with the result that, for a description thereof, reference may be made to the statements made in respect of the exemplary embodiments above in their entirety.

The invention claimed is:

1. A screw compressor, including a compressor housing having a screw rotor chamber arranged therein, two screw rotors that are arranged in the screw rotor chamber and are mounted on the compressor housing, each rotatably about a respective screw rotor axis, and engage in each other by means of their helical contours and each cooperate with compression wall surfaces which are adjacent thereto and partly surround them in order to receive gaseous medium that is supplied by way of a low-pressure chamber arranged in the compressor housing and to discharge it in a region of a high-pressure chamber that is arranged in the compressor housing, wherein the gaseous medium is enclosed in compression chambers that are formed between the helical contours and compression wall surfaces that are adjacent to the latter with an intake volume at low pressure and is compressed to a final volume at high pressure, and including at least one control slider that is arranged in a slider channel of the compressor housing and is adjacent to both screw rotors by means of slider compression wall surfaces and is movable in a direction of displacement parallel to the screw rotor axes and take a form that affects at least one of the final volume and an initial volume, a position determining device is provided for the at least one control slider, the position determining device has at least one position indicator that is coupled to the at least one control slider, the at least one position indicator cooperates with a detector that extends parallel to the direction of displacement of the at least one control slider and along which the position indicator is movable to indicate the positions of the position indicator along the detector, wherein the detector is arranged in a detector channel that extends along the compressor housing parallel to and radially outward of the slider channel in overlapping relation with the slider channel, parallel to the direction of displacement of the at least one slider.

2. The screw compressor according to claim 1, wherein the detector channel is closed by a cover.

3. The screw compressor according to claim 1, wherein the detector channel is formed by a groove-like recess, which spans the cover, in a base body of the compressor housing.

4. The screw compressor according to claim 3, wherein the cover itself has a groove-like recess that forms part of the detector channel.

5. The screw compressor according to claim 4, wherein the detector extends only within the groove-like recess in the cover.

6. The screw compressor according to claim 1, wherein the respective position indicator is arranged in the detector channel.

7. The screw compressor according to claim 1, wherein the respective position indicator is mechanically coupled to the respective control slider by way of a connecting body.

8. The screw compressor according to claim 1, wherein a respective connecting body, which couples the respective position indicator to the respective control slider, passes through an elongate passage between the detector channel and a slider channel that receives the at least one control slider.

9. The screw compressor according to claim 8, wherein the respective connecting body and the elongate passage together guide the respective control slider in the direction of displacement such that it does not rotate.

10. The screw compressor according to claim 1, wherein the respective position indicator cooperates with the detector without contact.

11. The screw compressor according to claim 1, wherein there is provided a controller that controls a slider drive for the respective control slider and determines the movement of the respective control slider by means of the position determining device.

12. The screw compressor according to claim 11, wherein the controller positions the respective control slider in a position-controlled manner.

13. The screw compressor according to claim 11, wherein the controller determines the positions of the control sliders while taking into account at least one or more of parameters of a refrigeration cycle of the screw compressor, including parameters related to components of the screw compressor and to the gasous medium.

14. The screw compressor according to claim 13, wherein the at least one or more parameters are one or more of a pressure level at low pressure, a pressure level at high pressure, a temperature of the gaseous medium at high pressure and low pressure, a speed of rotation of the screw rotors a power consumption of a drive motor, parameters of the gaseous medium, and application limits of the screw compressor.

15. The screw compressor according to claim 1, wherein the detector is arranged along the compressor housing in overlapping relation with the with the slider channel.

16. The screw compressor according to claim 1, wherein the slider channel comprises and extends into retraction chambers for the at least one control slider, and wherein the slider channel extends axially beyond both ends of the detector channel.

17. The screw compressor according to claim 1, wherein the at least one control slider comprises first and second control sliders, the first and second control sliders slidable into first and second retraction chambers of said retraction chambers, respectively.

18. A screw compressor, including a compressor housing having a screw rotor chamber arranged therein, two screw rotors that are arranged in the screw rotor chamber and are mounted on the compressor housing, each rotatably about a respective screw rotor axis, and engage in each other by means of their helical contours and each cooperate with compression wall surfaces which are adjacent thereto and partly surround them in order to receive gaseous medium that is supplied by way of a low-pressure chamber arranged in the compressor housing and to discharge it in a region of a high-pressure chamber that is arranged in the compressor housing, wherein the gaseous medium is enclosed in compression chambers that are formed between the helical contours and compression wall surfaces that are adjacent to the latter with an intake volume at low pressure and is compressed to a final volume at high pressure, and including at least one control slider that is arranged in a slider channel of the compressor housing and is adjacent to both screw rotors by means of slider compression wall surfaces and is movable in a direction of displacement parallel to the screw rotor axes and take a form that affects at least one of the final volume and an initial volume, the screw compressor has two control sliders, wherein a first control slider takes a form that affects the final volume and a second control slider takes a form that affects the initial volume, wherein a position determining device is provided for the two control sliders that includes a first position indicator, coupled to the first control slider, and a second position indicator, coupled to the second control slider, wherein both position indicators cooperate with a common detector that extends parallel to the direction of displacement of the control sliders and along which the position indicators are movable when the control sliders are moved, and the common detector is coupled to an evaluation device to indicate the respective positions of the position indicators along the common detector.

19. The screw compressor according to claim 18, wherein the common detector is arranged in a detector channel that extends within the compressor housing, parallel to the direction of displacement.

20. The screw compressor according to claim 19, wherein the detector channel is closed by a cover.

21. The screw compressor according to claim 19, wherein the detector channel is formed by a groove-like recess, which spans the cover, in a base body of the compressor housing.

22. The screw compressor according to claim 20, wherein the cover itself has a groove-like recess that forms part of the detector channel.

23. The screw compressor according to claim 22, wherein the common detector extends only within the groove-like recess in the cover.

24. The screw compressor according to claim 19, wherein the respective position indicator is arranged in the detector channel.

25. The screw compressor according to claim 18, wherein the respective position indicator is mechanically coupled to the respective control slider by way of a connecting body.

26. The screw compressor according to claim 18, wherein a respective connecting body passes through an elongate passage between a detector channel for the common detector and a slider channel that receives the at least one control slider.

27. The screw compressor according to claim 26, wherein the respective connecting body and the elongate passage together guide the respective control slider in the direction of displacement such that it does not rotate.

28. The screw compressor according to claim 18, wherein the respective position indicator cooperates with the common detector without contact.

29. The screw compressor according to claim 18, wherein there is provided a controller that controls a slider drive for the respective control slider and determines the movement of the respective control slider by means of the position determining device.

30. The screw compressor according to claim 29, wherein the controller positions the respective control slider in a position-controlled manner.

31. The screw compressor according to claim 29, wherein the controller determines the positions of the control sliders while taking into account at least one or more of operational parameters of a refrigeration cycle of the screw compressor including parameters related to components of the screw compressor and to the gaseous medium.

32. The screw compressor according to claim 31, wherein the at least one or more parameters are one or more of a pressure level at low pressure, a pressure level at high pressure, a temperature of the gaseous medium at high pressure and low pressure, a speed of rotation of the screw rotors, a power consumption of a drive motor, parameters of the gaseous medium, and application limits of the screw compressor.

33. The screw compressor according to claim 18, wherein the first control slider and the second control slider are arranged one behind the other in the direction of displacement thereof.

34. The screw compressor according to claim 33, wherein the first control slider and the second control slider have identical external contours.

35. The screw compressor according to claim 33, wherein the first control slider and the second control slider are positionable directly succeeding one another in a combined position and are movable together in the direction of displacement.

36. The screw compressor according to claim 33, wherein the first and the second control slider are positionable in a separated position, spaced from one another, forming an intermediate space.

37. The screw compressor according to claim 18, wherein the first control slider has mutually directly adjacent slider compression wall surfaces, of which in each case one is adjacent to one of the screw rotors, and in that the second control slider has slider compression wall surfaces that are arranged spaced from one another, of which in each case one is adjacent to one of the screw rotors.

38. The screw compressor according to claim 37, wherein the first control slider is mounted on the second control slider.

39. The screw compressor according to claim 37, wherein the slider compression wall surfaces of the first control slider and the second control slider succeed one another.

40. A screw compressor, including a compressor housing having a screw rotor chamber arranged therein, two screw rotors that are arranged in the screw rotor chamber and are mounted on the compressor housing, each rotatably about a respective screw rotor axis, and engage in each other by means of their helical contours and each cooperate with compression wall surfaces which are adjacent thereto and partly surround them in order to receive gaseous medium that is supplied by way of a low-pressure chamber arranged in the compressor housing and to discharge it in a region of a high-pressure chamber that is arranged in the compressor housing, wherein the gaseous medium is enclosed in compression chambers that are formed between the helical contours and compression wall surfaces that are adjacent to the latter with an intake volume at low pressure and is compressed to a final volume at high pressure, and including at least one control slider that is arranged in a slider channel of the compressor housing and is adjacent to both screw rotors by means of slider compression wall surfaces and is movable in a direction of displacement parallel to the screw rotor axes and take a form that affects at least one of the final volume and an initial volume, the screw compressor has two control sliders, a first control slider and a second control slider are arranged one behind the other in the direction of displacement thereof, the first control slider is arranged on a side of the second control slider facing the high-pressure chamber, and wherein the first control slider is guided in relation to the second control slider by a telescopic guide; and wherein the telescopic guide including a guide receptacle and a guide body, with the guide body held on one of the two control sliders and the guide receptacle formed in one of the two control sliders.

41. The screw compressor according to claim 40, wherein the telescopic guide has a smaller play transversely to the direction of displacement than guidance of the first control slider through a slider channel receiving the latter.

42. The screw compressor according to claim 41, wherein the guide bushing is arranged at an end of the first control slider facing the second control slider.

43. The screw compressor according to claim 40, wherein the telescopic guide has a guide body that is rigidly connected to the second control slider and on which the first control slider is movably guided in the direction of displacement by means of a guide bushing.

44. The screw compressor according to claim 43, wherein the first control slider is guided on the guide body exclusively by means of the guide bushing.

45. The screw compressor according to claim 40, wherein the first control slider is rigidly connected to a piston rod that leads to a cylinder arrangement for moving the first control slider, and in that the first control slider is guided in relation to the compressor housing by means of a guide bushing that receives the piston rod such that it is movable in the direction of displacement.

46. The screw compressor according to claim 45, wherein the piston rod is arranged on an opposite side of the first control slider to the second control slider.

47. The screw compressor according to claim 46, wherein a play between the guide bushing and the piston rod transversely to the direction of displacement is smaller than the play of the first control slider guided in the slider channel transversely to the direction of displacement.

48. The screw compressor according to claim 45, wherein the guide bushing is held fixedly on the compressor housing.

* * * * *